US011260658B2

(12) United States Patent
Nakagawa et al.

(10) Patent No.: US 11,260,658 B2
(45) Date of Patent: Mar. 1, 2022

(54) LIQUID EJECTION HEAD, LIQUID EJECTION APPARATUS, AND LIQUID EJECTION MODULE

(71) Applicant: CANON KABUSHIKI KAISHA, Tokyo (JP)

(72) Inventors: Yoshiyuki Nakagawa, Kawasaki (JP); Akiko Hammura, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/526,312

(22) Filed: Jul. 30, 2019

(65) Prior Publication Data

US 2020/0039223 A1 Feb. 6, 2020

(30) Foreign Application Priority Data

Jul. 31, 2018 (JP) ..... JP2018-143884
Apr. 18, 2019 (JP) ..... JP2019-079641

(51) Int. Cl.
*B41J 2/14* (2006.01)

(52) U.S. Cl.
CPC ..... *B41J 2/14201* (2013.01); *B41J 2/1433* (2013.01)

(58) Field of Classification Search
CPC ..... B41J 2/0458; B41J 2/14048; B41J 2002/14193; B41J 2002/14467; B41J 2/211
See application file for complete search history.

(56) References Cited

U.S. PATENT DOCUMENTS 6,151,049 A * 11/2000 Karita ..... B41J 2/14048 347/65
6,474,783 B1 11/2002 Pilossof et al.
7,857,422 B2 12/2010 Delametter et al.
9,481,172 B2 11/2016 Hirai
9,498,969 B2 11/2016 Kobayashi
10,717,273 B2 7/2020 Nakagawa et al.
2002/0012026 A1* 1/2002 Kubota ..... B41J 2/1634 347/56
2009/0115820 A1 5/2009 Nomura et al.
(Continued)

FOREIGN PATENT DOCUMENTS

CN 104943381 A 9/2015
CN 105365396 A 3/2016
(Continued)

OTHER PUBLICATIONS

Hideki, MachineTranslationofJP-06305143-A, 1994 (Year: 1994).*
(Continued)

*Primary Examiner* — Scott A Richmond
(74) *Attorney, Agent, or Firm* — Venable LLP

(57) ABSTRACT

A liquid ejection head includes a pressure chamber that allows a first liquid and a second liquid to flow inside, a pressure generation element that applies pressure to the first liquid and an ejection port that ejects the second liquid. In a state where the first liquid flows in a direction, crossing a direction of ejection of the second liquid from the ejection port, while being in contact with the pressure generation element and the second liquid flows in the crossing direction along the first liquid in the pressure chamber, the second liquid is ejected from the ejection port by causing the pressure generation element to apply a pressure to the first liquid.

21 Claims, 21 Drawing Sheets

(56) References Cited

U.S. PATENT DOCUMENTS

| | | | | |
|---|---|---|---|---|
| 2010/0026743 | A1* | 2/2010 | Van Thillo | C09D 11/322 347/9 |
| 2016/0271956 | A1 | 9/2016 | Kinoshita et al. | |
| 2018/0056288 | A1* | 3/2018 | Abate | B01L 3/0268 |
| 2018/0207938 | A1 | 7/2018 | Ohnishi | |
| 2018/0236764 | A1* | 8/2018 | Mu | B41J 2/1404 |
| 2019/0009554 | A1 | 1/2019 | Nakagawa | |
| 2019/0016133 | A1* | 1/2019 | Govyadinov | B41J 2/1404 |

FOREIGN PATENT DOCUMENTS

| | | | | |
|---|---|---|---|---|
| EP | 3 124 252 | A2 | | 2/2017 |
| JP | 05-169663 | A | | 7/1993 |
| JP | 06-305143 | A | | 11/1994 |
| JP | 06305143 | A | * | 11/1994 |
| JP | 2007-112099 | A | | 5/2007 |
| TW | 200911543 | A | | 3/2009 |
| WO | 2017/169683 | A1 | | 10/2017 |
| WO | 2018/193446 | A1 | | 10/2018 |

OTHER PUBLICATIONS

Office Action dated Jul. 30, 2020, in Indian Patent Application No. 201944030674.

Extended European Search Report dated Nov. 28, 2019, in European Patent Application No. 19189000.3.

U.S. Appl. No. 16/526,024, Yoshiyuki Nakagawa Akiko Hammura, filed Jul. 30, 2019.

U.S. Appl. No. 16/526,054, Yoshiyuki Nakagawa Akiko Hammura, filed Jul. 30, 2019.

U.S. Appl. No. 16/526,285, Yoshiyuki Nakagawa Akiko Hammura, filed Jul. 30, 2019.

Search Report dated Apr. 27, 2020, in Russian Patent Application No. 2019124003.

Office Action dated May 26, 2021, in Taiwanese Patent Application No. 108126892.

* cited by examiner

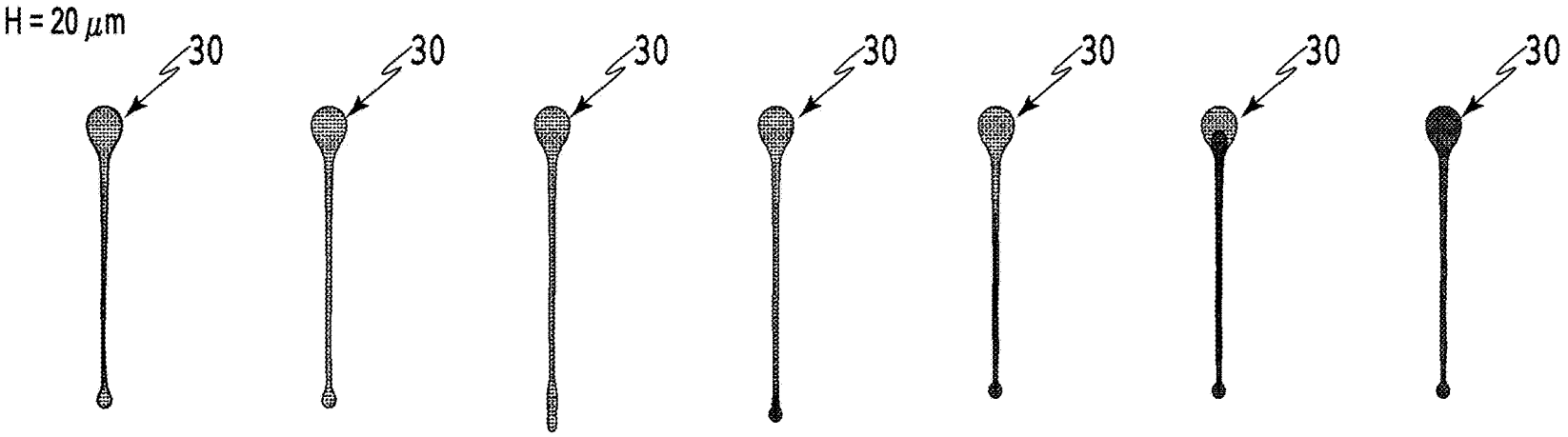
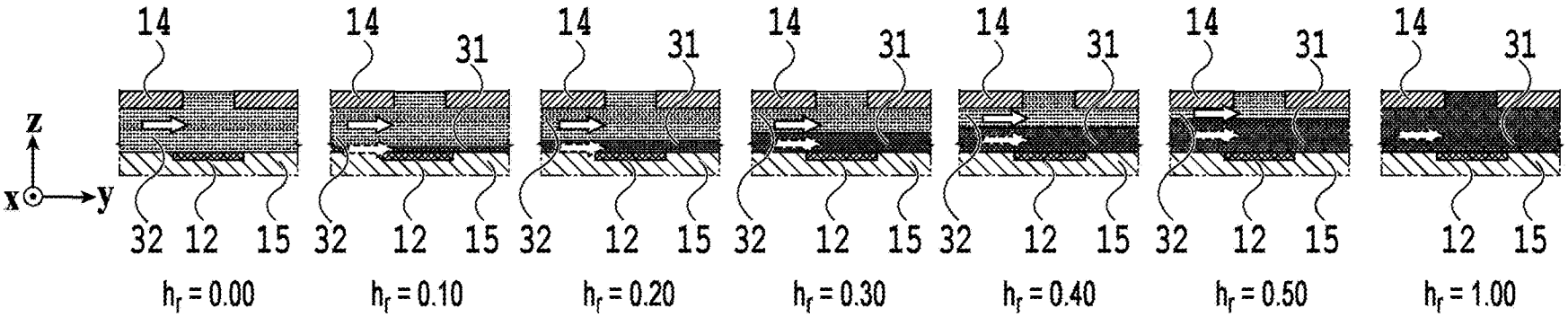
FIG.8A FIG.8B FIG.8C FIG.8D FIG.8E FIG.8F FIG.8G

LIQUID EJECTION HEAD, LIQUID EJECTION APPARATUS, AND LIQUID EJECTION MODULE

BACKGROUND OF THE INVENTION

Field of the Invention

This disclosure is related to a liquid ejection head, a liquid ejection module, and a liquid ejection apparatus.

Description of the Related Art

Japanese Patent Laid-Open No. H6-305143 discloses a liquid ejection unit configured to bring a liquid serving as an ejection medium and a liquid serving as a bubbling medium into contact with each other on an interface, and to eject the ejection medium with a growth of a bubble generated in the bubbling medium receiving transferred thermal energy. Japanese Patent Laid-Open No. H6-305143 describes a method of forming flows of the ejection medium and the bubbling medium by applying a pressure to these media after ejection of the ejection medium, thus stabilizing the interface between the ejection medium and the bubbling medium in a liquid flow passage.

SUMMARY OF THE INVENTION

In a first aspect of this disclosure, there is provided a liquid ejection head comprising: a pressure chamber configured to allow a first liquid and a second liquid to flow inside; a pressure generation element configured to apply pressure to the first liquid; and an ejection port configured to eject the second liquid, wherein in a state where the first liquid flows in a direction, crossing a direction of ejection of the second liquid from the ejection port, while being in contact with the pressure generation element and the second liquid flows in the crossing direction along the first liquid in the pressure chamber, the second liquid is ejected from the ejection port by causing the pressure generation element to apply a pressure to the first liquid.

In a second aspect of this disclosure, there is provided a liquid ejection apparatus including a liquid ejection head, the liquid ejection head comprising a pressure chamber configured to allow a first liquid and a second liquid to flow inside, a pressure generation element configured to apply pressure to the first liquid, and an ejection port configured to eject the second liquid, wherein in a state where the first liquid flows in a direction, crossing a direction of ejection of the second liquid from the ejection port, while being in contact with the pressure generation element and the second liquid flows in the crossing direction along the first liquid in the pressure chamber, the second liquid is ejected from the ejection port by causing the pressure generation element to apply a pressure to the first liquid.

In a third aspect of this disclosure, there is provided a liquid ejection module for configuring a liquid ejection head, the liquid ejection module comprising: a pressure chamber configured to allow a first liquid and a second liquid to flow inside; a pressure generation element configured to apply pressure to the first liquid; and an ejection port configured to eject the second liquid, wherein in a state where the first liquid flows in a direction, crossing a direction of ejection of the second liquid from the ejection port, while being in contact with the pressure generation element and the second liquid flows in the crossing direction along the first liquid in the pressure chamber, the second liquid is ejected from the ejection port by causing the pressure generation element to apply a pressure to the first liquid, and the liquid ejection head is formed by arraying multiple liquid ejection modules.

Further features of the present disclosure will become apparent from the following description of exemplary embodiments with reference to the attached drawings.

BRIEF DESCRIPTION OF THE DRAWINGS

FIGS. 8A to 8G are diagrams illustrating ejected droplets at various water phase thickness ratios;

DESCRIPTION OF THE EMBODIMENTS

Nonetheless, in the configuration to form the interface between the ejection medium and the bubbling medium by applying the pressure to the two media every time an ejection operation takes place as disclosed in Japanese Patent Laid-Open No. H 6-305143, the interface is prone to be unstable in the course of the repeated ejection operations.

As a consequence, quality of an output obtained by depositing the ejection medium may be deteriorated due to fluctuations in medium components contained in ejected droplets and fluctuations in amount and velocity of the ejected droplets.

This disclosure has been made to solve the aforementioned problem. As such, an object of this disclosure is to provide a liquid ejection head which is capable of stabilizing an interface between an ejection medium and a bubbling medium in a case where an ejection operation takes place, thus maintaining good ejection performances.

First Embodiment (Configuration of Liquid Ejection Head)

Figure 1:
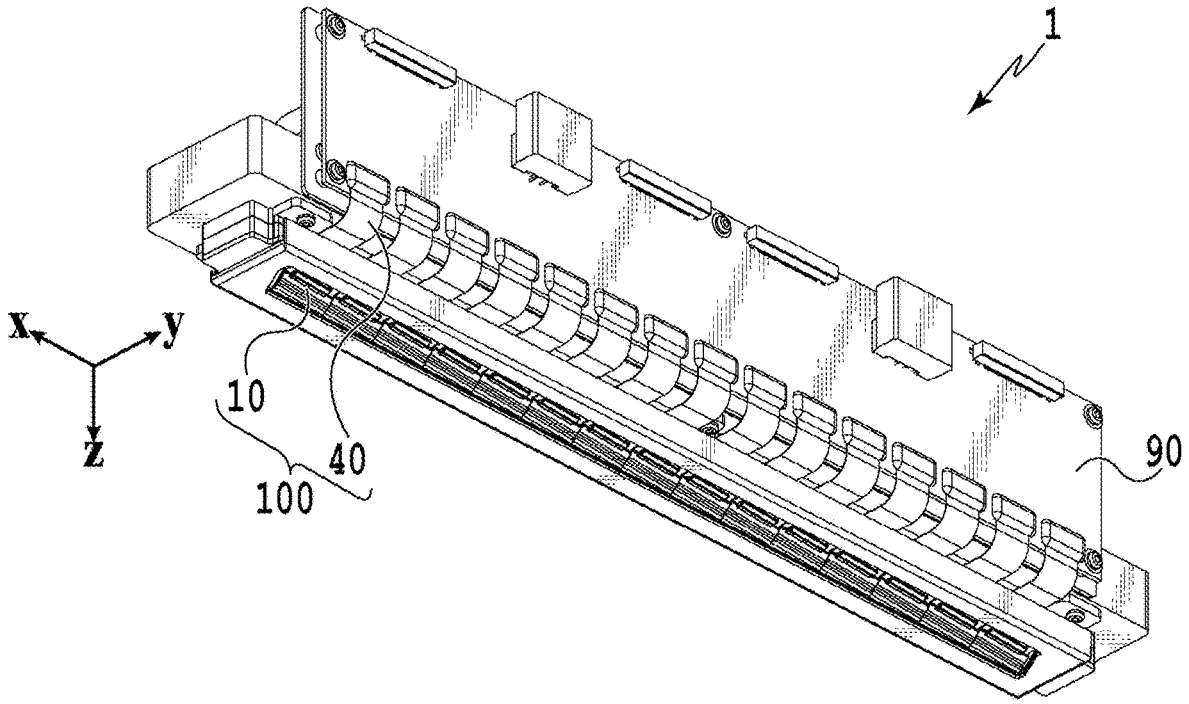
FIG. 1 is a perspective view of an ejection head.

FIG. 1 is a perspective view of a liquid ejection head 1 usable in this embodiment. The liquid ejection head 1 of this embodiment is formed by arraying multiple liquid ejection modules 100 in an x direction. Each liquid ejection module 100 includes an element board 10 on which ejection elements are arrayed, and a flexible wiring board 40 for supplying electric power and ejection signals to the respective ejection elements. The flexible wiring boards 40 are connected to an electric wiring board 90 used in common, which is provided with arrays of power supply terminals and ejection signal input terminals. Each liquid ejection module 100 is easily attachable to and detachable from the liquid ejection head 1. Accordingly, any desired liquid ejection module 100 can be easily attached from outside to or detached from the liquid ejection head 1 without having to disassemble the liquid ejection head 1.

Given the liquid ejection head 1 formed by arraying the multiple arrangement of the liquid ejection modules 100 (by an array of multiple modules) in a longitudinal direction as described above, even if a certain one of the ejection elements causes an ejection failure, only the liquid ejection module involved in the ejection failure needs to be replaced. Thus, it is possible to improve a yield of the liquid ejection heads 1 during a manufacturing process thereof, and to reduce costs for replacing the head.

(Configuration of Liquid Ejection Apparatus)

Figure 2:
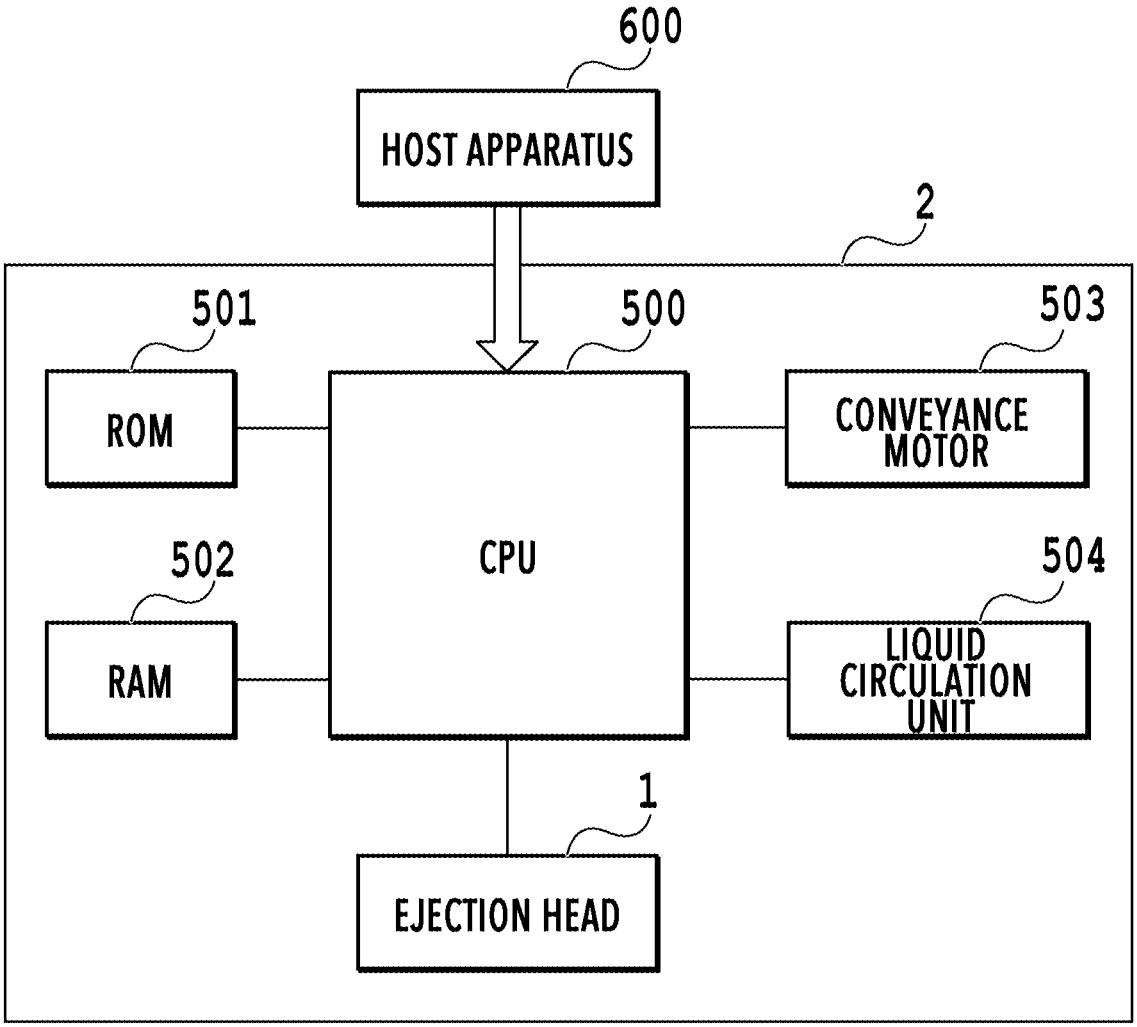
FIG. 2 is a block diagram for explaining a control configuration of a liquid ejection apparatus.

FIG. 2 is a block diagram showing a control configuration of a liquid ejection apparatus 2 applicable to this embodiment. A CPU 500 controls the entire liquid ejection apparatus 2 in accordance with programs stored in a ROM 501 while using a RAM 502 as a work area. The CPU 500 performs prescribed data processing in accordance with the programs and parameters stored in the ROM 501 on ejection data to be received from an externally connected host apparatus 600, for example, thereby generating the ejection signals to enable the liquid ejection head 1 to perform the ejection. Then, the liquid ejection head 1 is driven in accordance with the ejection signals while a target medium for depositing the liquid is moved in a predetermined direction by driving a conveyance motor 503. Thus, the liquid ejected from the liquid ejection head 1 is deposited on the deposition target medium for adhesion.

A liquid circulation unit 504 is a unit configured to circulate and supply the liquid to the liquid ejection head 1 and to conduct flow control of the liquid in the liquid ejection head 1. The liquid circulation unit 504 includes a sub-tank to store the liquid, a flow passage for circulating the liquid between the sub-tank and the liquid ejection head 1, pumps, a flow rate control unit for controlling a flow rate of the liquid flowing in the liquid ejection head 1, and so forth. Hence, under the instruction of the CPU 500, these mechanisms are controlled such that the liquid flows in the liquid ejection head 1 at a predetermined flow rate.

(Configuration of Element Board)

Figure 3:
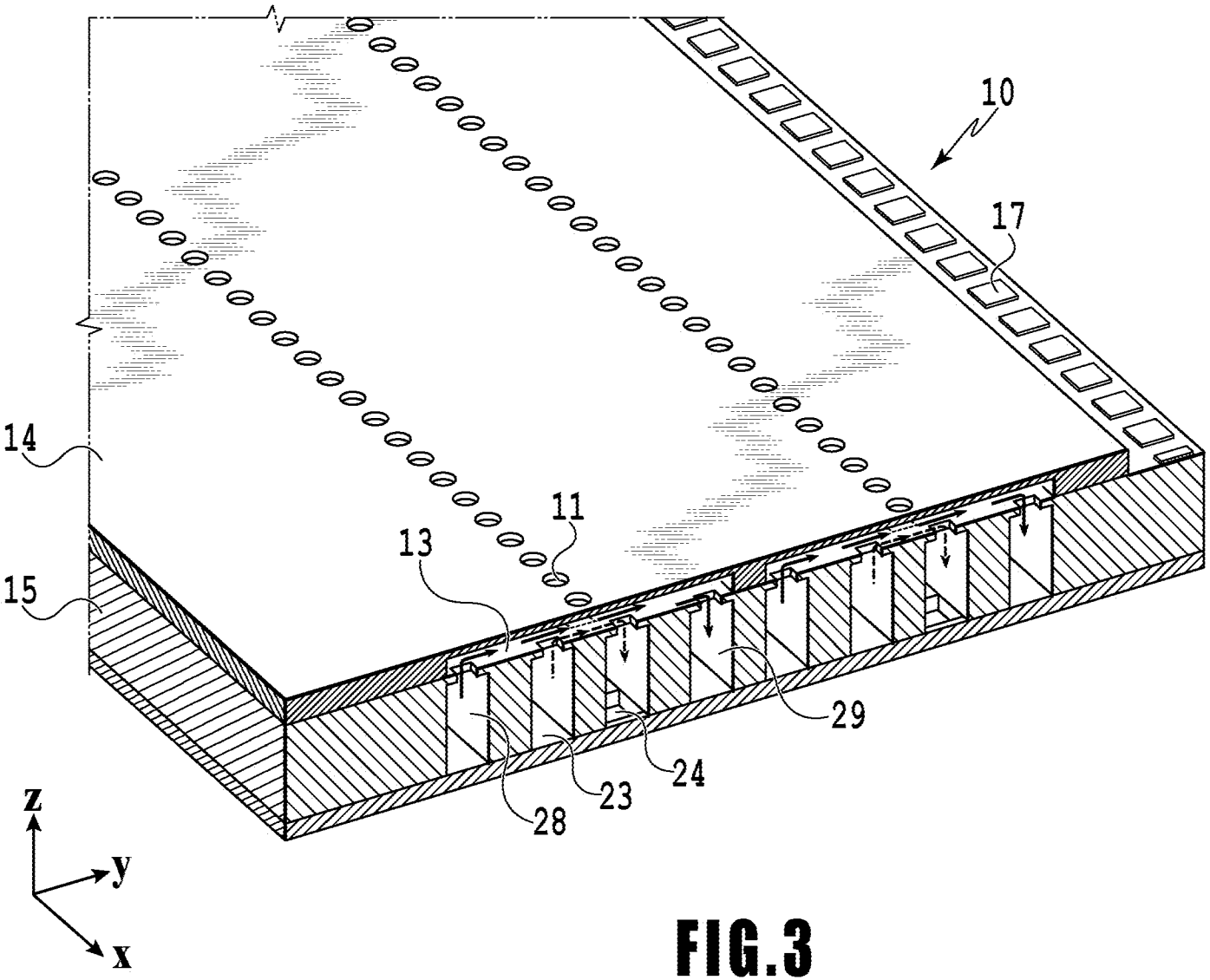
FIG. 3 is a cross-sectional perspective view of an element board in a liquid ejection module.

FIG. 3 is a cross-sectional perspective view of the element board 10 provided in each liquid ejection module 100. The element board 10 is formed by stacking an orifice plate 14 (an ejection port forming member) on a silicon (Si) substrate 15. In FIG. 3, ejection ports 11 arrayed in the x direction eject the liquid of the same type (such as a liquid supplied from a common sub-tank or a common supply port). FIG. 3 illustrates an example in which the orifice plate 14 is also provided with liquid flow passages 13. Instead, the element board 10 may adopt a configuration in which the liquid flow passages 13 are formed by using a different component (a flow passage forming member) and the orifice plate 14 provided with the ejection ports 11 is placed thereon.

Pressure generation elements 12 (not shown in FIG. 3) are disposed, on the silicon substrate 15, at positions corresponding to the respective ejection ports 11. Each ejection port 11 and the corresponding pressure generation element 12 are located at such positions that are opposed to each other. In a case where a voltage is applied in response to an ejection signal, the pressure generation element 12 applies a pressure to the liquid in a z direction orthogonal to a flow direction (a y direction) of the liquid. Accordingly, the liquid is ejected in the form of a droplet from the ejection port 11 opposed to the pressure generation element 12. The flexible wiring board 40 (see FIG. 1) supplies the electric power and driving signals to the pressure generation elements 12 via terminals 17 arranged on the silicon substrate 15.

The orifice plate 14 is provided with the multiple liquid flow passages 13 which extend in the y direction and are connected one by one to the ejection ports 11, respectively. Meanwhile, the liquid flow passages 13 arrayed in the x direction are connected to a first common supply flow passage 23, a first common collection flow passage 24, a second common supply flow passage 28, and a second common collection flow passage 29 in common. Flows of liquids in the first common supply flow passage 23, the first common collection flow passage 24, the second common supply flow passage 28, and the second common collection flow passage 29 are controlled by the liquid circulation unit 504 described with reference to FIG. 2. To be more precise, the liquid circulation unit 504 performs the control such that a first liquid flowing from the first common supply flow passage 23 into the liquid flow passages 13 is directed to the first common collection flow passage 24 while a second liquid flowing from the second common supply flow passage 28 into the liquid flow passages 13 is directed to the second common collection flow passage 29.

FIG. 3 illustrates an example in which the ejection ports 11 and the liquid flow passages 13 arrayed in the x direction, and the first and second common supply flow passages 23 and 28 as well as the first and second common collection flow passages 24 and 29 used in common for supplying and collecting inks to and from these ports and passages are defined as a set, and two sets of these constituents are arranged in the y direction. FIG. 3 illustrates the configuration in which each ejection port is located at the position opposed to the corresponding pressure generation element 12, or in other words, in a direction of growth of a bubble. However, this embodiment is not limited only to this configuration. For example, each ejection port may be located at such a position that is orthogonal to the direction of growth of a bubble.

(Configurations of Flow Passage and Pressure Chamber)

Figure 4A:
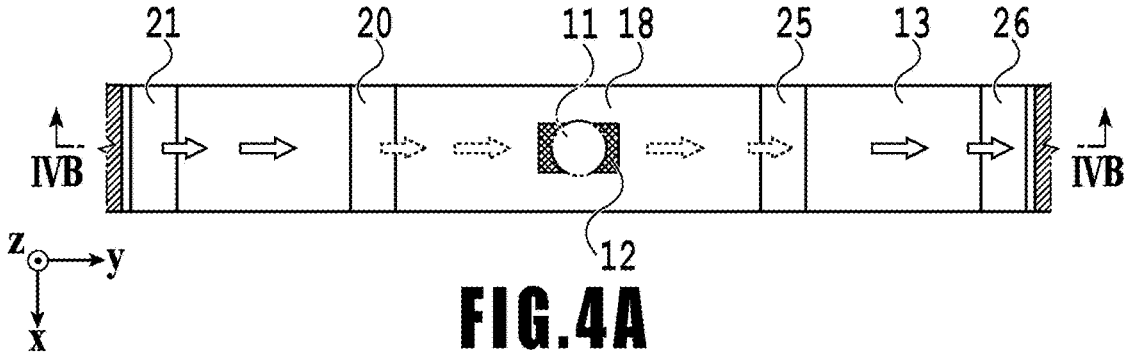
FIGS. 4A to 4D illustrate enlarged details of a liquid flow passage and a pressure chamber in a first embodiment.
Figure 4B:
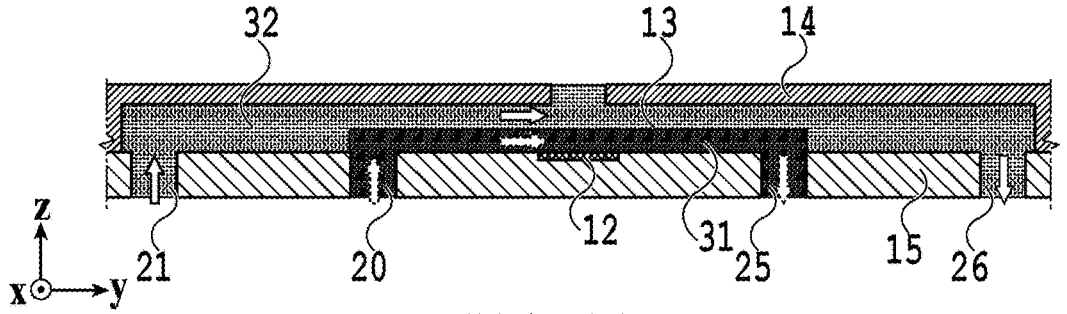
Figure 4C:
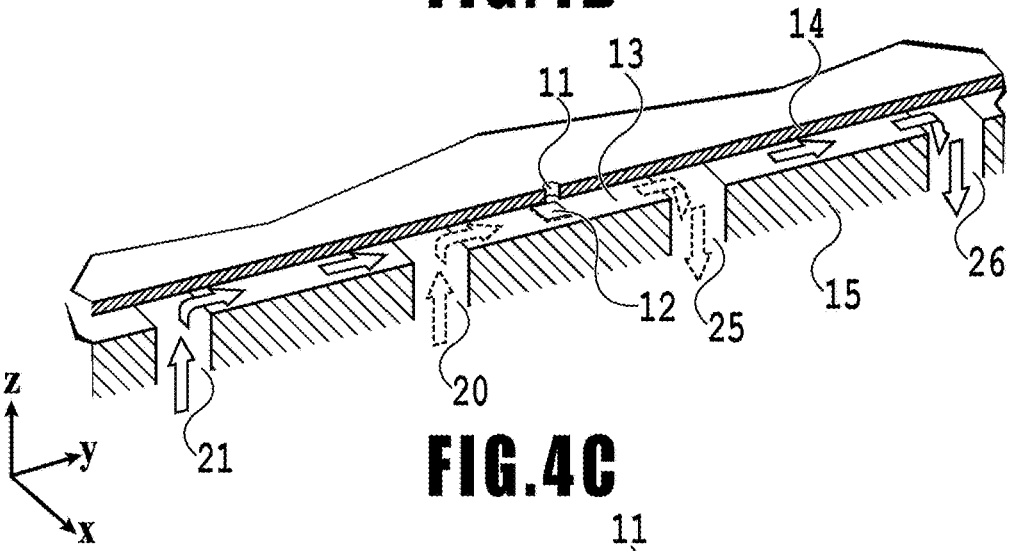
Figure 4D:
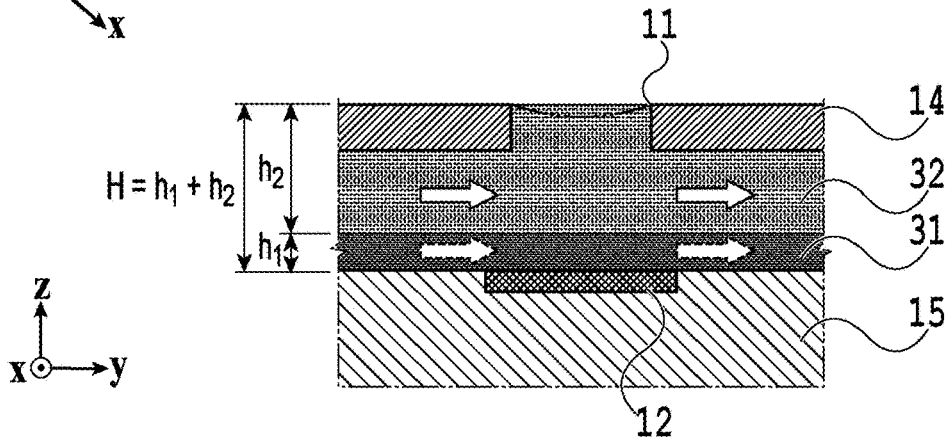

FIGS. 4A to 4D are diagrams for explaining detailed configurations of each liquid flow passage 13 and of each pressure chamber 18 formed in the element board 10. FIG. 4A is a perspective view from the ejection port 11 side (from a +z direction side) and FIG. 4B is a cross-sectional view taken along the IVB-IVB line shown in FIG. 4A. Meanwhile, FIG. 4C is an enlarged diagram of the neighborhood of each liquid flow passage 13 in the element board shown in FIG. 3. Moreover, FIG. 4D is an enlarged diagram of the neighborhood of the ejection port in FIG. 4B.

The silicon substrate 15 corresponding to a bottom portion of the liquid flow passage 13 includes a second inflow port 21, a first inflow port 20, a first outflow port 25, and a second outflow port 26, which are formed in this order in the y direction. Moreover, the pressure chamber 18 communicating with the ejection port 11 and including the pressure generation element 12 is located substantially at the center between the first inflow port 20 and the first outflow port 25 in the liquid flow passage 13. The second inflow port 21 is connected to the second common supply flow passage 28, the first inflow port 20 is connected to the first common supply flow passage 23, the first outflow port 25 is connected to the first common collection flow passage 24, and the second outflow port 26 is connected to the second common collection flow passage 29, respectively (see FIG. 3).

In the configuration described above, a first liquid 31 supplied from the first common supply flow passage 23 to the liquid flow passage 13 through the first inflow port 20 flows in the y direction (the direction indicated with arrows). The first liquid 31 goes through the pressure chamber 18 and is then collected into the first common collection flow passage 24 through the first outflow port 25. Meanwhile, a second liquid 32 supplied from the second common supply flow passage 28 to the liquid flow passage 13 through the second inflow port 21 flows in the y direction (the direction indicated with arrows). The second liquid 32 goes through the pressure chamber 18 and is then collected into the second common collection flow passage 29 through the second outflow port 26. That is to say, in the liquid flow passage 13, both of the first liquid and the second liquid flow in the y direction in a section between the first inflow port 20 and the first outflow port 25.

In the pressure chamber 18, the pressure generation element 12 comes into contact with the first liquid 31 while the second liquid 32 exposed to the atmosphere forms a meniscus in the vicinity of the ejection port 11. The first liquid 31 and the second liquid 32 flow in the pressure chamber 18 such that the pressure generation element 12, the first liquid 31, the second liquid 32, and the ejection port 11 are arranged in this order. Specifically, assuming that the pressure generation element 12 is located on a lower side and the ejection port 11 is located on an upper side, the second liquid 32 flows above the first liquid 31. The first liquid 31 and the second liquid 32 flow in a laminar state. Moreover, the first liquid 31 and the second liquid 32 are pressurized by the pressure generation element 12 located below and are ejected upward from the bottom. Note that this up-down direction corresponds to a height direction of the pressure chamber 18 and of the liquid flow passage 13.

In this embodiment, a flow rate of the first liquid 31 and a flow rate of the second liquid 32 are adjusted in accordance with physical properties of the first liquid 31 and physical properties of the second liquid 32 such that the first liquid 31 and the second liquid 32 flow in contact with each other in the pressure chamber as shown in FIG. 4D. Although the first liquid, the second liquid, and a third liquid are allowed to flow in the same direction in the first embodiment and a second embodiment, the embodiments are not limited to this configuration. Specifically, the second liquid may flow in a direction opposite to the direction of flow of the first liquid. Alternatively, flow passages may be provided in such a way as to cause the flow of the first liquid to cross the flow of the second liquid at right angle. In the meantime, the liquid ejection head is configured such that the second liquid flows above the first liquid in terms of the height direction of the liquid flow passage (the pressure chamber). However, this embodiment is not limited only to this configuration. Specifically, as in a third embodiment, both of the first liquid and the second liquid may flow in contact with a bottom surface of the liquid flow passage (the pressure chamber).

Modes of the above-mentioned two liquids include not only parallel flows in which the two liquids flow in the same direction as shown in FIG. 4D, but also opposed flows in which the second liquid flows in an opposite direction to the flow of the first liquid, and such flows of liquids in which the flow of the first liquid crosses the flow of the second liquid. In the following, the parallel flows among these modes will be described as an example.

In the case of the parallel flows, it is preferable to keep an interface between the first liquid 31 and the second liquid 32 from being disturbed, or in other words, to establish a state of laminar flows inside the pressure chamber 18 with the flows of the first liquid 31 and the second liquid 32. Specifically, in the case of an attempt to control an ejection performance so as to maintain a predetermined amount of ejection, it is preferable to drive the pressure generation element in a state where the interface is stable. Nevertheless, this embodiment is not limited only to this configuration. Even if the flow inside the pressure chamber 18 would transition to a state of turbulence whereby the interface between the two liquids would be somewhat disturbed, the pressure generation element 12 may still be driven in the case where it is possible to maintain the state where at least the first liquid flows mainly on the pressure generation element 12 side and the second liquid flows mainly on the ejection port 11 side. The following description will be mainly focused on the example where the flow inside the pressure chamber is in the state of parallel flows and in the state of laminar flows.

(Conditions to Form Parallel Flows in Concurrence with Laminar Flows)

Conditions to form laminar flows of liquids in a tube will be described to begin with. The Reynolds number to represent a ratio between viscous force and interfacial force has been generally known as a flow evaluation index.

Now, a density of a liquid is defined as ρ, a flow velocity thereof is defined as u, a representative length thereof is defined as d, a viscosity is defined as η, and a surface tension thereof is defined as γ. In this case, the Reynolds number can be expressed by the following (formula 1):

$$Re=\rho ud/\eta \quad \text{(formula 1).}$$

Here, it is known that the laminar flows are more likely to be formed as the Reynolds number Re becomes smaller. To be more precise, it is known that flows inside a circular tube are formed into laminar flows in the case where the Reynolds number Re is smaller than some 2200 and the flows inside the circular tube become turbulent flows in the case where the Reynolds number Re is larger than some 2200.

In the case where the flows are formed into the laminar flows, flow lines become parallel to a traveling direction of the flows without crossing each other. Accordingly, in the case where the two liquids in contact constitute the laminar flows, the liquids can form the parallel flows while stably defining the interface between the two liquids.

Here, in view of a general inkjet printing head, a height H [μm] of the flow passage (the height of the pressure chamber) in the vicinity of the ejection port in the liquid flow passage (the pressure chamber) is in a range from about 10 to 100 μm. In this regard, in the case where water (density $\rho=1.0\times103$ kg/m$^3$, viscosity $\eta=1.0$ cP) is fed to the liquid flow passage of the inkjet printing head at a flow velocity of 100 mm/s, the Reynolds number Re turns out to be $Re=\rho ud/\eta\approx0.1\sim1.0<<2200$. As a consequence, the laminar flows can be deemed to be formed therein.

Here, even if the liquid flow passage 13 and the pressure chamber 18 of this embodiment have rectangular cross-sections as shown in FIGS. 4A to 4D, the heights and widths of the liquid flow passage 13 and the pressure chamber 18 in the liquid ejection head are sufficiently small. For this reason, the liquid flow passage 13 and the pressure chamber 18 can be treated like in the case of the circular tube, or more specifically, the heights of the liquid flow passage and the pressure chamber 18 can be treated as the diameter of the circular tube.

(Theoretical Conditions to Form Parallel Flows in State of Laminar Flows)

Next, conditions to form the parallel flows with the stable interface between the two types of liquids in the liquid flow passage 13 and the pressure chamber 18 will be described with reference to FIG. 4D. First of all, a distance from the silicon substrate 15 to an ejection port surface of the orifice plate 14 is defined as H [μm] and a distance from the ejection port surface to a liquid-liquid interface between the first liquid 31 and the second liquid 32 (a phase thickness of the second liquid) is defined as $h_2$ [μm]. In the meantime, a distance from the liquid-liquid interface to the silicon substrate 15 (a phase thickness of the first liquid) is defined as $h_1$ [μm]. These definitions bring about $H=h_1+h_2$.

As for boundary conditions in the liquid flow passage 13 and the pressure chamber 18, velocities of the liquids on wall surfaces of the liquid flow passage 13 and the pressure chamber 18 are assumed to be zero. Moreover, velocities and shear stresses of the first liquid 31 and the second liquid 32 at the liquid-liquid interface are assumed to have continuity. Based on the assumption, if the first liquid 31 and the second liquid 32 form two-layered and parallel steady flows, then a quartic equation as defined in the following (formula 2) holds true in a section of the parallel flows:

$$(\eta_1-\eta_2)(\eta_1Q_1+\eta_2Q_2)h_1^4+2\eta_1H\{\eta_2(3Q_1+Q_2)-2\eta_1Q_1\}h_1^3+3\eta_1H^2\{2\eta_1Q_1-\eta_2(3Q_1+Q_2)\}h_1^2+4\eta_1Q_1H^3(\eta_2-\eta_1)h_1+\eta_1^2Q_1H^4=0 \quad \text{(formula 2).}$$

In the (formula 2), $\eta_1$ represents the viscosity of the first liquid, $\eta_2$ represents the viscosity of the second liquid, $Q_1$ represents the flow rate (volume flow rate [um$^3$/us]) of the first liquid, and $Q_2$ represents the flow rate (volume flow rate [um$^3$/us]) of the second liquid, respectively. In other words, the first liquid and the second liquid flow so as to establish a positional relationship in accordance with the flow rates and the viscosities of the respective liquids within such ranges to satisfy the above-mentioned quartic equation (formula 2), thereby forming the parallel flows with the stable interface. In this embodiment, it is preferable to form the parallel flows of the first liquid and the second liquid in the liquid flow passage 13 or at least in the pressure chamber 18. In the case where the parallel flows are formed as mentioned above, the first liquid and the second liquid are only involved in mixture due to molecular diffusion on the liquid-liquid interface therebetween, and the liquids flow in parallel in the y direction virtually without causing any mixture. Note that the flows of the liquids do not always have to establish the state of laminar flows in a certain region in the pressure chamber 18. In this context, at least the flows of the liquids in a region above the pressure generation element preferably establish the state of laminar flows.

Even in the case of using immiscible solvents such as oil and water as the first liquid and the second liquid, for example, the stable parallel flows are formed regardless of the immiscibility as long as the (formula 2) is satisfied. Meanwhile, even in the case of oil and water, if the interface is disturbed due to a state of slight turbulence of the flow in the pressure chamber, it is preferable that at least the first liquid flows mainly on the pressure generation element and the second liquid flows mainly in the ejection port.

Figure 5A:
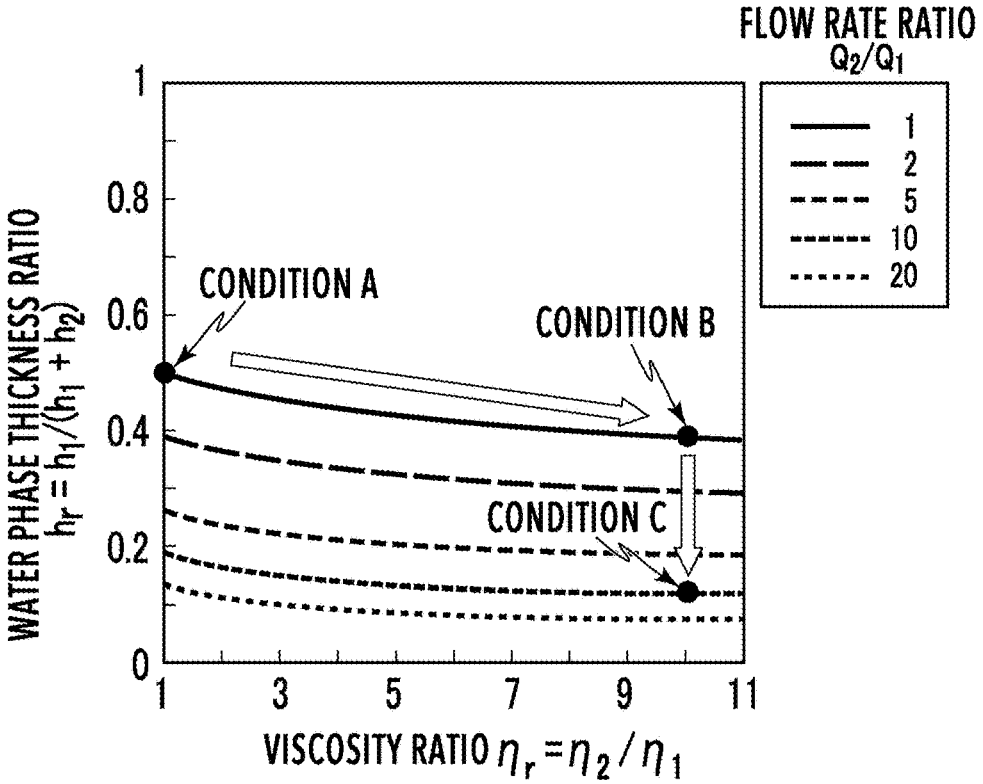
FIGS. 5A and 5B are graphs representing relations between a viscosity ratio and a water phase thickness ratio, and relations between a height of the pressure chamber and a flow velocity.

FIG. 5A is a graph representing a relation between a viscosity ratio $\eta_r=\eta_2/\eta_1$ and a phase thickness ratio $h_r=h_1/(h_1+h_2)$ of the first liquid while changing a flow rate ratio $Q_r=Q_2/Q_1$ to several levels based on the (formula 2). Although the first liquid is not limited to water, the "phase thickness ratio of the first liquid" will be hereinafter referred to as a "water phase thickness ratio". The horizontal axis indicates the viscosity ratio $\eta_r=\eta_2/\eta_1$ and the vertical axis indicates the water phase thickness ratio $h_r=h_1/(h_1+h_2)$, respectively. The water phase thickness ratio $h_r$ becomes lower as the flow rate ratio $Q_r$ grows higher. Meanwhile, at each level of the flow rate ratio $Q_r$, the water phase thickness ratio $h_r$ becomes lower as the viscosity ratio $\eta_r$ grows higher. In other words, the water phase thickness ratio $h_r$ (the position of the interface between the first liquid and the second liquid) in the liquid flow passage 13 (the pressure chamber) can be adjusted to a prescribed value by controlling the viscosity ratio $\eta_r$ and the flow rate ratio $Q_r$ between the first liquid and the second liquid. In addition, in the case where the viscosity ratio fir is compared with the flow rate ratio $Q_r$, FIG. 5A teaches that the flow rate ratio $Q_r$ has a larger impact on the water phase thickness ratio $h_r$ than the viscosity ratio $\eta_r$ does.

Note that condition A, condition B, and condition C shown in FIG. 5A represent the following conditions, respectively:

the water phase thickness ratio $h_r=0.50$ in the case where the viscosity ratio $\eta_r=1$ and the flow rate ratio $Q_r=1$; Condition A)

the water phase thickness ratio $h_r=0.39$ in the case where the viscosity ratio $\eta_r=10$ and the flow rate ratio $Q_r=1$; and Condition B)

the water phase thickness ratio $h_r=0.12$ in the case where the viscosity ratio $\eta_r=10$ and the flow rate ratio $Q_r=10$. Condition C)

Figure 5B:
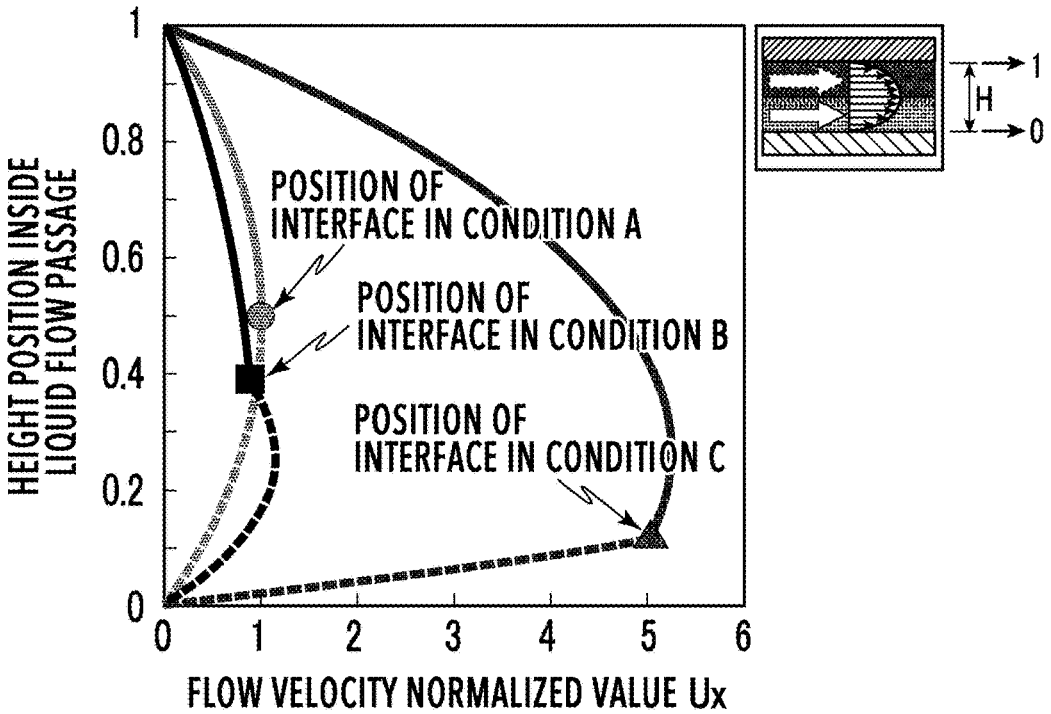

FIG. 5B is a graph showing flow velocity distribution in the height direction (the z direction) of the liquid flow passage 13 (the pressure chamber) regarding the above-mentioned conditions A, B, and C, respectively. The horizontal axis indicates a normalized value Ux which is normalized by defining the maximum flow velocity value in the condition A as 1 (a criterion). The vertical axis indicates the height from a bottom surface in the case where the height H of the liquid flow passage 13 (the pressure chamber) is defined as 1 (a criterion). On each of curves indicating the respective conditions, the position of the interface between the first liquid and the second liquid is indicated with a marker. FIG. 5B shows that the position of the interface varies depending on the conditions such as the position of the interface in the condition A being located higher than the positions of the interface in the condition B and the condition C. The variations are due to the fact that, in the case where the two types of liquids having different viscosities from each other flow in parallel in the tube while forming the laminar flows, respectively (and also forming the laminar flows as a whole), the interface between those two liquids is formed at a position where a difference in pressure attributed to the difference in viscosity between the liquid balances a Laplace pressure attributed to interfacial tension.

(Relation Between Flow Rate Ratio and Water Phase Thickness Ratio)

Figure 6:
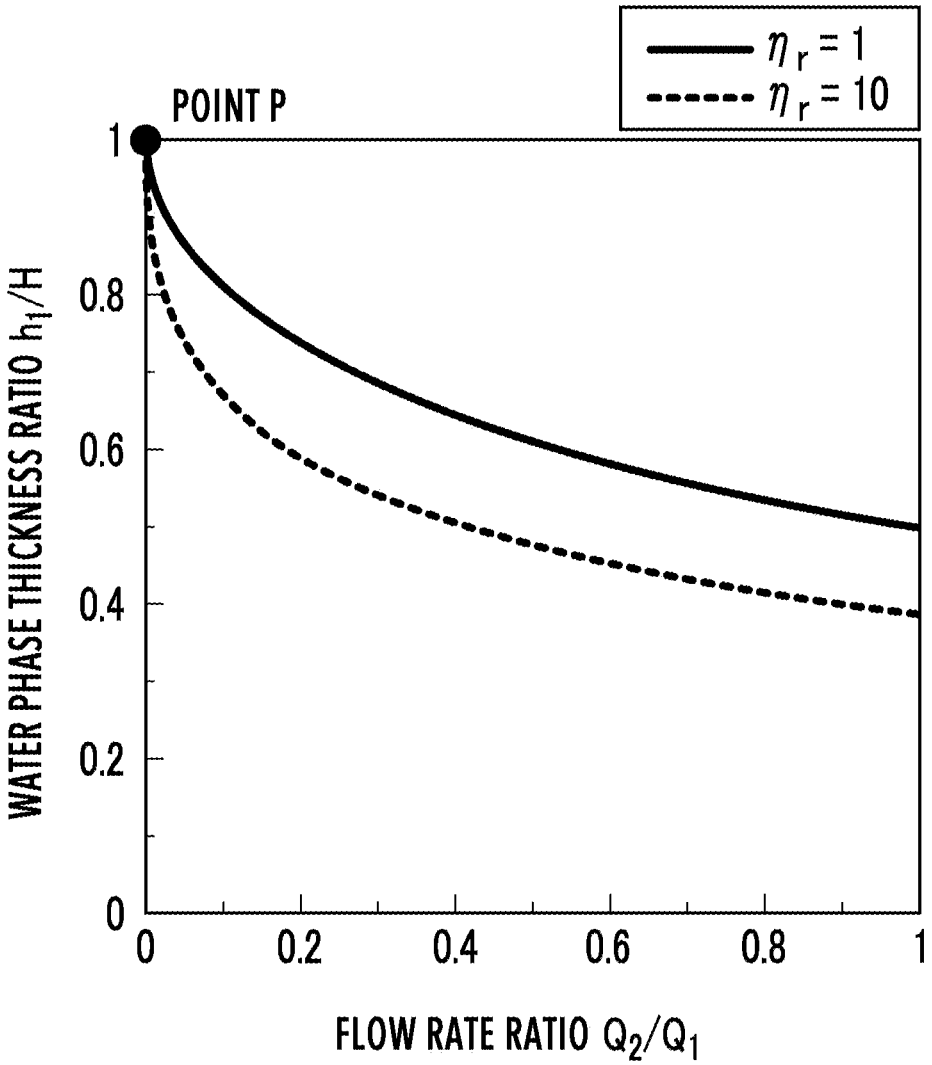
FIG. 6 is a graph representing relations between a flow rate ratio and the water phase thickness ratio.

FIG. 6 is a graph showing a relation between the flow rate ratio $Q_r$ and the water phase thickness ratio $h_r$ based on the (formula 2) in the case where the viscosity ratio $\eta_r=1$ and in the case where the viscosity ratio $\eta_r=10$. The horizontal axis indicates the flow rate ratio $Q_r=Q_2/Q_1$ and the vertical axis indicates the water phase thickness ratio $h_r=h_1/(h_1+h_2)$. The flow rate ratio $Q_r=0$ corresponds to the case of $Q_2=0$, where the liquid flow passage is filled with the first liquid only and there is no second liquid therein. Here, the water phase thickness ratio $h_r$ is equal to 1. A point P in FIG. 6 shows this state.

If the ratio $Q_r$ is set higher than the position of the point P (that is, if a flow rate $Q_2$ of the second liquid is set higher than 0), the water phase thickness ratio $h_r$, namely, the water phase thickness $h_1$ of the first liquid becomes smaller while the water phase thickness $h_2$ of the second liquid becomes larger. In other words, the state of the flow of the first liquid only transitions to the state of the first liquid and the second liquid flowing in parallel while defining the interface. Moreover, it is possible to confirm the above-mentioned tendency both in the case where the viscosity ratio $\eta_r=1$ and in the case where the viscosity ratio $\eta_r=10$ between the first liquid and the second liquid.

In other words, in order to establish the state where the first liquid and the second liquid flow in the liquid flow passage 13 along with each other while defining the interface therebetween, it is necessary to satisfy the flow rate ratio $Q_r=Q_2/Q_1>0$, or in other words, to satisfy $Q_1>0$ and $Q_2>0$. This means that both of the first liquid and the second liquid are flowing in the same direction which is the y direction.

(Transitional States in Ejection Operation)

Next, a description will be given of transitional states in an ejection operation in the liquid flow passage 13 and the pressure chamber 18 in which the parallel flows are formed. FIGS. 7A to 7E are diagrams schematically illustrating transitional states in the case of carrying out an ejection operation in a state of forming the parallel flows of the first liquid and the second liquid with the viscosity ratio $\eta_r=4$ in the liquid flow passage 13 having the height of the flow passage (the pressure chamber) of H [μm]=20 μm with the thickness of the orifice plate set to T=6 μm.

Figures 7A, 7B, 7C, 7D, 7E:
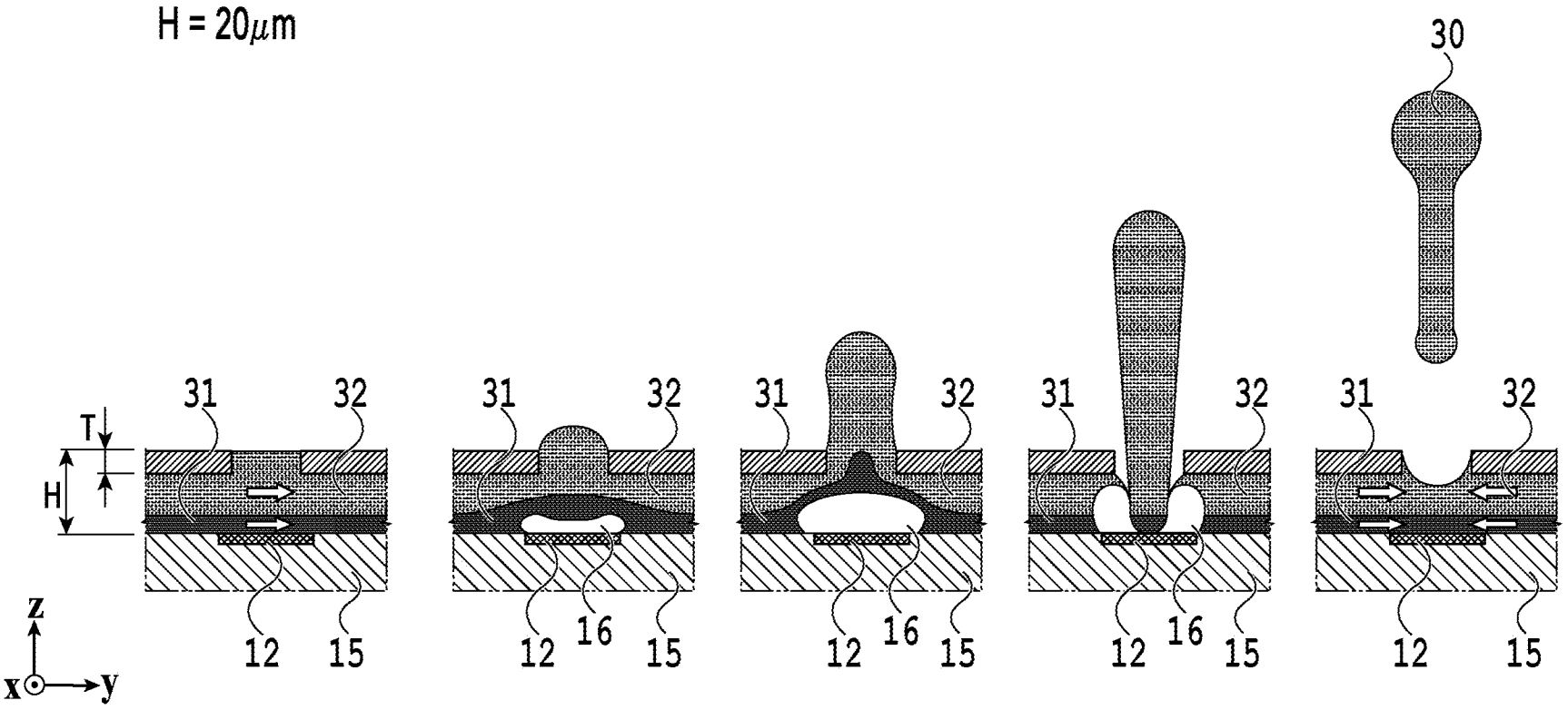
FIGS. 7A to 7E are diagrams schematically illustrating transitional states in an ejection operation.
Figures 9A, 9B, 9C, 9D, 9E:
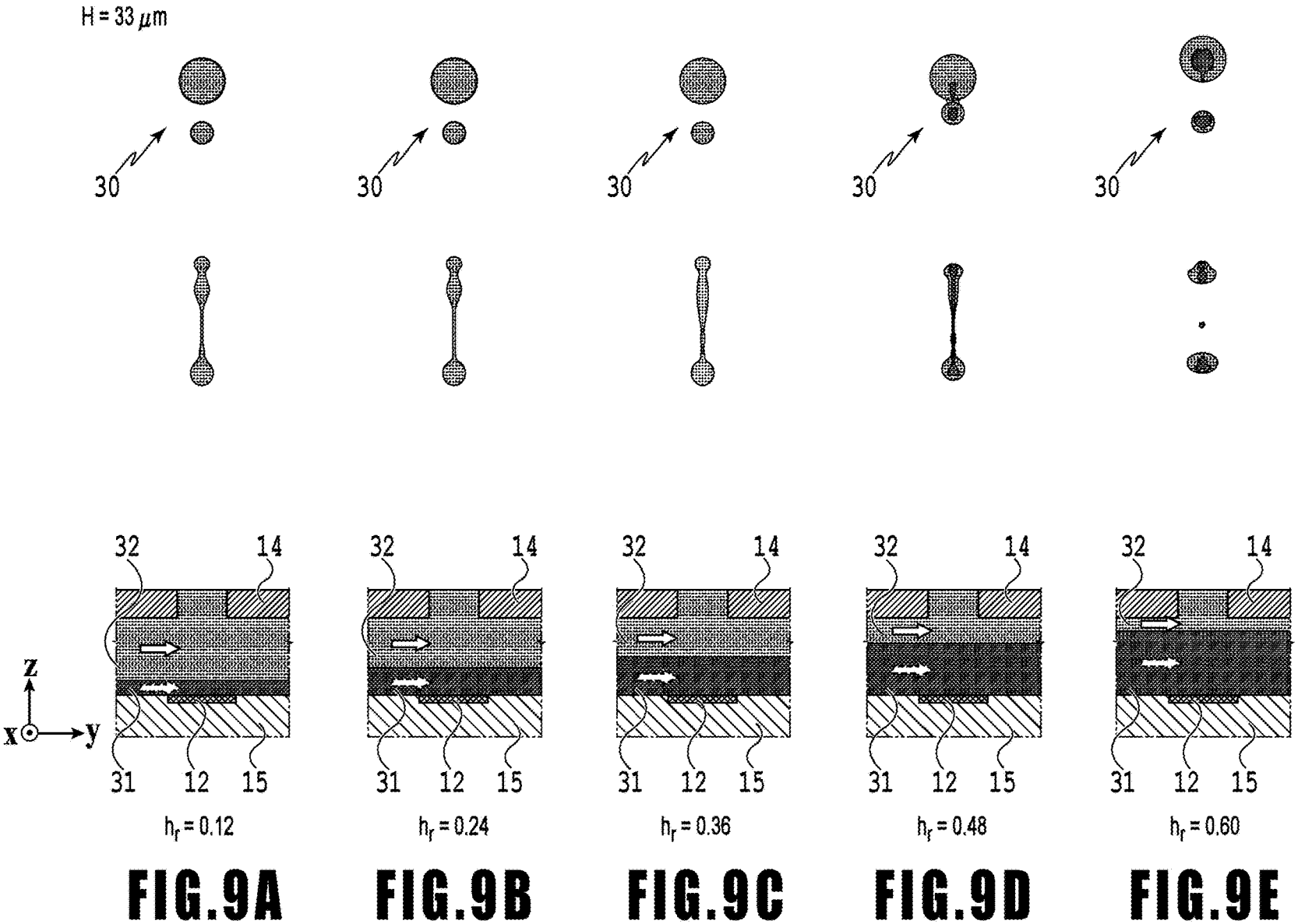
FIGS. 9A to 9E are more diagrams illustrating ejected droplets at various water phase thickness ratios.

FIG. 7A shows a state before a voltage is applied to the pressure generation element 12. Here, FIG. 7A shows the state where the position of the interface is stable at such a position that achieves the water phase thickness ratio $h_r=0.57$ (that is, the water phase thickness of the first liquid $h_1$ [μm]=6 μm) by appropriately adjusting the value $Q_1$ of the first liquid and the value $Q_2$ of the second liquid which flow together.

FIG. 7B shows a state where application of the voltage to the pressure generation element 12 has just been started. The pressure generation element 12 of this embodiment is an electrothermal converter (a heater). To be more precise, the pressure generation element 12 rapidly generates heat upon receipt of a voltage pulse in response to the ejection signal, and causes film boiling of in the first liquid in contact. FIG. 7B shows the state where a bubble 16 is generated by the film boiling. Along with the generation of the bubble 16, the interface between the first liquid 31 and the second liquid 32 moves in the z direction (the height direction of the pressure chamber) whereby the second liquid 32 is pushed out of the ejection port 11 in the z direction.

FIG. 7C shows a state where the volume of the bubble 16 generated by the film boiling is increased whereby the second liquid 32 is further pushed out of the ejection port 11 in the z direction.

FIG. 7D shows a state where the bubble 16 communicates with the atmosphere. In this embodiment, a gas-liquid interface moving from the ejection port 11 toward the pressure generation element 12 communicates with the bubble 16 at a stage of shrinkage after the bubble 16 grows to the maximum.

FIG. 7E shows a state where a droplet 30 is ejected. The liquid having projected out of the ejection port 11 at the timing of the communication of the bubble 16 with the atmosphere as shown in FIG. 7D breaks away from the liquid flow passage 13 due to its inertial force and flies in the z direction in the form of the droplet 30. Meanwhile, in the liquid flow passage 13, the liquid in the amount consumed by the ejection is supplied from two sides of the ejection port 11 by capillary force of the liquid flow passage 13 whereby the meniscus is formed again at the ejection port 11. Then, the parallel flows of the first liquid and the second liquid flowing in the y direction are formed again as shown in FIG. 7A.

As described above, in this embodiment, the ejection operation as shown in FIGS. 7A to 7E takes place in the state where the first liquid and the second liquid are flowing as the parallel flows. To describe further in detail with reference to FIG. 2 again, the CPU 500 circulates the first liquid and the second liquid in the liquid ejection head 1 by using the liquid circulation unit 504 while keeping the constant flow rates of these liquids. Then the CPU 500 applies the voltage to the respective pressure generation elements 12 arranged in the liquid ejection head 1 in accordance with the ejection data while maintaining the above-mentioned control. Here, depending on the amount of the liquid to be ejected, the flow rate of the first liquid and the flow rate of the second liquid may not always be constant.

In the case where the ejection operation is conducted in the state where the liquids are flowing, the flows of the liquids may adversely affect ejection performances. However, in the general inkjet printing head, an ejection velocity of each droplet is in the order of several meters per second to more than ten meters per second, which is much higher than the flow velocity in the liquid flow passage that is in the order of several millimeters per second to several meters per second. Accordingly, even if the ejection operation is conducted in the state where the first liquid and the second liquid are flowing in the range from several millimeters per second to several meters per second, there is little risk of adverse effects on the ejection performances.

This embodiment shows the configuration in which the bubble 16 communicates with the atmosphere in the pressure chamber 18. However, the embodiment is not limited to this configuration. For instance, the bubble 16 may communicate with the atmosphere on the outside (the atmosphere side) of the ejection port 11. Alternatively, the bubble 16 may be allowed to disappear without communicating with the atmosphere.

(Ratios of Liquids Contained in Ejected Droplet)

FIGS. 8A to 8G are diagrams for comparing the ejected droplet in the case where the water phase thickness ratio $h_r$ is changed stepwise in the liquid flow passage 13 (the pressure chamber) having the flow-passage (pressure-chamber) height of H [μm]=20 μm. In FIGS. 8A to 8F, the water phase thickness ratio $h_r$ is incremented by 0.10 whereas the water phase thickness ratio $h_r$ is incremented by 0.50 from the state in FIG. 8F to the state in FIG. 8G. Note that each of the ejected droplets in FIGS. 8A to 8G is illustrated based on a result obtained by conducting a simulation while setting the viscosity of the first liquid to 1 cP, the viscosity of the second liquid to 8 cP, and the ejection velocity of the droplet to 11 m/s.

The water phase thickness ratio $h_1$ of the first liquid 31 is lower as the water phase thickness ratio $h_r$ ($=h_1/(h_1+h_2)$) shown in FIG. 4D is closer to 0, and the water phase thickness $h_1$ of the first liquid 31 is higher as the water phase thickness ratio $h_r$ is closer to 1. Accordingly, while the second liquid 32 located close to the ejection port 11 is mainly contained in the ejected droplet 30, the ratio of the first liquid 31 contained in the ejected droplet 30 is also increased as the water phase thickness ratio $h_r$ comes closer to 1.

In the case of FIGS. 8A to 8G where the flow-passage (pressure-chamber) height is set to H [μm]=20 μm, only the second liquid 32 is contained in the ejected droplet 30 if the water phase thickness ratio $h_r$=0.00, 0.10, or 0.20 and no first liquid 31 is contained in the ejected droplet 30. However, in the case where the water phase thickness ratio $h_r$=0.30 or higher, the first liquid 31 is also contained in the ejected droplet 30 besides the second liquid 32. In the case where the water phase thickness ratio $h_r$=1.00 (that is, the state where the second liquid is absent), only the first liquid 31 is contained in the ejected droplet 30. As described above, the ratio between the first liquid 31 and the second liquid 32 contained in the ejected droplet 30 varies depending on the water phase thickness ratio $h_r$ in the liquid flow passage 13.

On the other hand, FIGS. 9A to 9E are diagrams for comparing the ejected droplet 30 in the case where the water phase thickness ratio $h_r$ is changed stepwise in the liquid flow passage 13 having the flow-passage (pressure-chamber) height of H [μm]=33 μm. In this case, only the second liquid 32 is contained in the ejected droplet 30 if the water phase thickness ratio $h_r$=0.36 or below. Meanwhile, the first liquid 31 is also contained in the ejected droplet 30 besides the second liquid 32 in the case where the water phase thickness ratio $h_r$=0.48 or above.

Figures 10A, 10B, 10C:
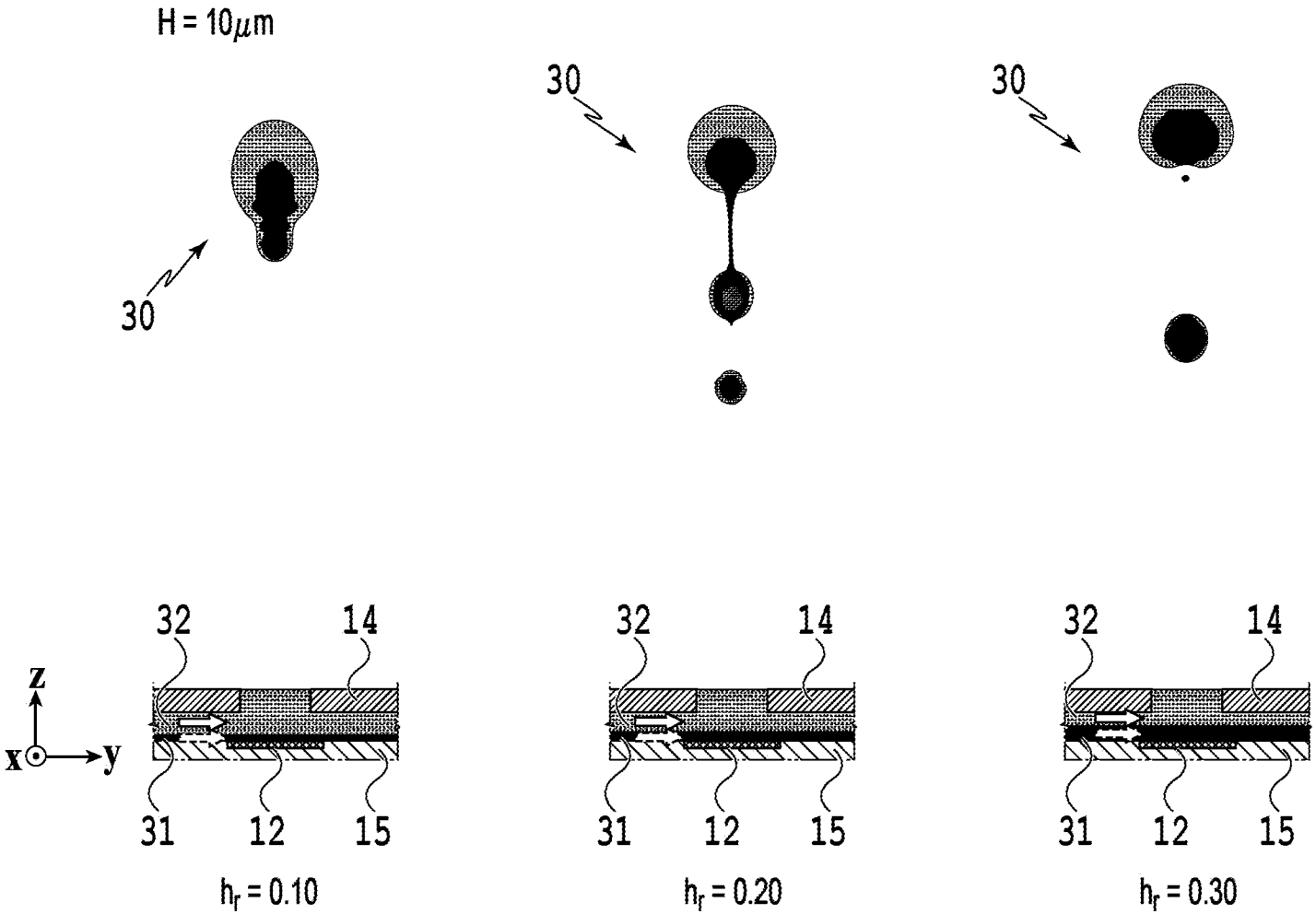
FIGS. 10A to 10C are more diagrams illustrating ejected droplets at various water phase thickness ratios.

In the meantime, FIGS. 10A to 10C are diagrams for comparing the ejected droplet 30 in the case where the water phase thickness ratio $h_r$ is changed stepwise in the liquid flow passage 13 having the flow-passage (pressure-chamber) height of H [μm]=10 μm. In this case, the first liquid 31 is contained in the ejected droplet 30 even in the case where the water phase thickness ratio $h_r$=0.10.

Figure 11:
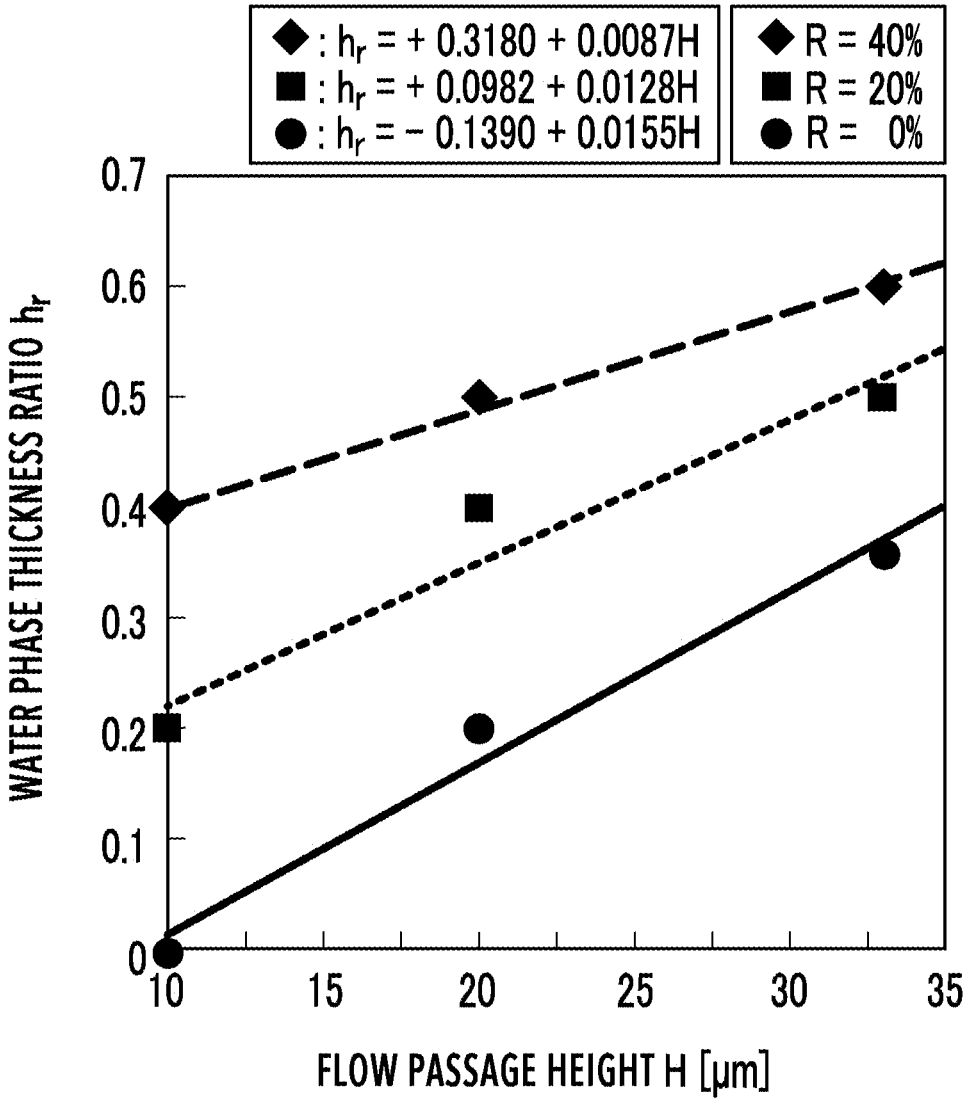
FIG. 11 is a graph representing a relation between a height of a flow passage (the pressure chamber) and the water phase thickness ratio.

FIG. 11 is a graph representing a relation between the flow-passage (pressure-chamber) height H and the water phase thickness ratio $h_r$ in the case of fixing a ratio R of the first liquid 31 contained in the ejected droplet 30, while setting the ratio R to 0%, 20%, and 40%. In any of the ratios R, the required water phase thickness ratio $h_r$ becomes higher as the flow-passage (pressure-chamber) height H is larger. Note that the ratio R of the first liquid 31 contained is a ratio of the liquid having flowed in the liquid flow passage 13 (the pressure chamber) to the ejected droplet as the first liquid 31. In this regard, even if each of the first liquid and the second liquid contains the same component such as water, the portion of water contained in the second liquid is not included in the aforementioned ratio as a matter of course.

In the case where the ejected droplet 30 contains only the second liquid 32 while eliminating the first liquid (R=0%), the relation between the flow-passage (pressure-chamber) height H [μm] and the water phase thickness ratio $h_r$ draws a locus as indicated with a solid line in FIG. 11. According to the investigation conducted by the inventors of this disclosure, the water phase thickness ratio $h_r$ can be approximated by a linear function of the flow-passage (pressure-chamber) height H [μm] shown in the following (formula 3):

$$h_r=-0.1390+0.0155H \quad \text{(formula 3).}$$

Moreover, in the case where the ejected droplet 30 is allowed to contain 20% of the first liquid (R=20%/o), the water phase thickness ratio $h_r$ can be approximated by a linear function of the flow-passage (pressure-chamber) height H [μm] shown in the following (formula 4):

$$h_r=+0.0982+0.0128H \quad \text{(formula 4).}$$

Furthermore, in the case where the ejected droplet 30 is allowed to contain 40% of the first liquid (R=40%), the water phase thickness ratio $h_r$ can be approximated by a linear function of the flow-passage (pressure-chamber) height H [μm] shown in the following (formula 5) according to the investigation by the inventors:

$$h_r=+0.3180+0.0087H \quad \text{(formula 5).}$$

For example, in order to cause the ejected droplet 30 to contain no first liquid, the water phase thickness ratio $h_r$ needs to be adjusted to 0.20 or below in the case where the flow-passage (pressure-chamber) height H [μm] is equal to 20 μm. Meanwhile, the water phase thickness ratio $h_r$ needs to be adjusted to 0.36 or below in the case where the flow-passage (pressure-chamber) height H [μm] is equal to 33 μm. Furthermore, the water phase thickness ratio $h_r$ needs to be adjusted to nearly zero (0.00) in the case where the flow-passage (pressure-chamber) height H [μm] is equal to 10 μm.

Nonetheless, if the water phase thickness ratio $h_r$ is set too low, it is necessary to increase the viscosity $\eta_2$ and the flow rate $Q_2$ of the second liquid relative to those of the first liquid. Such increases bring about concerns of adverse effects associated with an increase in pressure loss. For example, with reference to FIG. 5A again, in order to realize the water phase thickness ratio $h_r$=0.20, the flow rate ratio $Q_r$ is equal to 5 in the case where the viscosity ratio $\eta_r$ is equal to 10. Meanwhile, the flow rate ratio $Q_r$ is equal to 15 if the water phase thickness ratio is set to $h_r$=0.10 in order to obtain certainty of not ejecting the first liquid while using the same ink (that is, in the case of the same viscosity ratio $\eta_r$r). In other words, in order to adjust the water phase thickness ratio $h_r$ to 0.10, it is necessary to increase the flow rate ratio $Q_r$ three times as high as the case of adjusting the water phase thickness ratio $h_r$ to 0.20, and such an increase may bring about concerns of an increase in pressure loss and adverse effects associated therewith.

Note that the above-mentioned (formula 3), (formula 4), and (formula 5) define the numerical values applicable to the general liquid ejection head, namely, the liquid ejection head with the ejection velocity of the ejected droplets in a range from 10 m/s to 18 m/s. In addition, these numerical values are based on the assumption that the pressure generation element and the ejection port are located at the positions opposed to each other and that the first liquid and the second liquid flow such that the pressure generation element, the first liquid, the second liquid, and the ejection port are arranged in this order in the pressure chamber.

As described above, according to this embodiment, it is possible to stably conduct the ejection operation of the droplet containing the first liquid and the second liquid at the predetermined ratio by setting the water phase thickness ratio $h_r$ in the liquid flow passage 13 (the pressure chamber) to the predetermined value and thus stabilizing the interface.

Incidentally, in order to repeat the above-described ejection operation in the stable state, it is necessary to stabilize the position of the interface irrespective of the frequency of the ejection operation while achieving the targeted water phase thickness ratio $h_r$.

Here, a specific method for achieving the above-mentioned state will be described with reference to FIGS. 4A to 4C again. For example, a first pressure difference generation mechanism to set a pressure at the first outflow port 25 lower than a pressure at the first inflow port 20 has only to be prepared in order to adjust a flow rate $Q_1$ of the first liquid in the liquid flow passage 13 (the pressure chamber). In this way, it is possible to generate the flow of the first liquid 31 directed from the first inflow port 20 to the first outflow port 25 (in the y direction). In the meantime, a second pressure difference generation mechanism to set a pressure at the second outflow port 26 lower than a pressure at the second inflow port 21 has only to be prepared. In this way, it is possible to generate the flow of the second liquid 32 directed from the second inflow port 21 to the second outflow port 26 (in the y direction).

Moreover, it is possible to form the parallel flows of the first liquid and the second liquid flowing in the y direction at the desired water phase thickness ratio $h_r$ in the liquid flow passage 13 by controlling the first pressure difference generation mechanism and the second pressure difference generation mechanism while keeping a relation defined in the following (formula 6) so as not to cause any reverse flow in the liquid passage:

$$P2_{in} \geq P1_{in} > P1_{out} \geq P2_{out} \quad \text{(formula 6).}$$

Here, $P1_{in}$ is the pressure at the first inflow port 20, $P1_{out}$ is the pressure at the first outflow port 25, $P2_{in}$ is the pressure at the second inflow port 21, and $P2_{out}$ t is the pressure as the second outflow port 26, respectively. If the predetermined water phase thickness ratio $h_r$ can be maintained in the liquid flow passage (the pressure chamber) by controlling the first and second pressure difference generation mechanisms as described above, it is possible to recover the preferable parallel flows in a short time even if the position of the interface is disturbed along with the ejection operation, and to start the next ejection operation right away.

(Specific Examples of First Liquid and Second Liquid)

In the configuration of the embodiment described above, functions required by the respective liquids are clarified like the first liquid serving as a bubbling medium for causing the film boiling and the second liquid serving as an ejection medium to be ejected from the ejection port to the outside. According to the configuration of this embodiment, it is possible to increase the freedom of components to be contained in the first liquid and the second liquid more than those in the related art. Now, the bubbling medium (the first liquid) and the ejection medium (the second liquid) in this configuration will be described in detail based on specific examples.

The bubbling medium (the first liquid) of this embodiment is required to cause the film boiling in the bubbling medium in the case where the electrothermal converter generates the heat and to rapidly increase the size of the generated bubble, or in other words, to have a high critical pressure that can efficiently convert thermal energy into bubbling energy. Water is particularly suitable for such a medium. Water has the high boiling point (100° C.) as well as the high surface tension (58.85 dynes/cm at 100° C.) despite its small molecular weight of 18, and therefore has a high critical pressure of about 22 MPa. In other words, water brings about an extremely high boiling pressure at the time of the film boiling. In general, an ink prepared by causing water to contain a coloring material such as a dye or a pigment is suitably used in an inkjet printing apparatus designed to eject the ink by using the film boiling.

However, the bubbling medium is not limited to water. Other materials can also function as the bubbling media as long as such a material has a critical pressure of 2 MPa or above (or preferably 5 MPa or above). Examples of the bubbling media other than water include methyl alcohol and ethyl alcohol. It is also possible to use a mixture of water and any of these alcohols as the bubbling medium. Moreover, it is possible use a material prepared by causing water to contain the coloring material such as the dye and the pigment as mentioned above as well as other additives.

On the other hand, the ejection medium (the second liquid) of this embodiment is not required to satisfy physical properties for causing the film boiling unlike the bubbling medium. Meanwhile, adhesion of a scorched material onto the electrothermal converter (the heater) is prone to deteriorate bubbling efficiency because of damaging flatness of a heater surface or reducing thermal conductivity thereof. However, the ejection medium does not come into direct contact with the heater, and therefore has a lower risk of scorch of its components. Specifically, concerning the ejection medium of this embodiment, conditions of the physical properties for causing the film boiling or avoiding the scorch are relaxed as compared to those of an ink for a conventional thermal head. Accordingly, the ejection medium of this embodiment enjoys more freedom of the components to be contained therein. As a consequence, the ejection medium can more actively contain the components that are suitable for purposes after being ejected.

For example, in this embodiment, it is possible to cause the ejection medium to actively contain a pigment that has not been used previously because the pigment was susceptible to scorching on the heater. Meanwhile, a liquid other than an aqueous ink having an extremely low critical pressure can also be used as the ejection medium in this embodiment. Furthermore, it is also possible to use various inks having special functions, which can hardly be handled by the conventional thermal head such as an ultraviolet curable ink, an electrically conductive ink, an electron-beam (EB) curable ink, a magnetic ink, and a solid ink, can also be used as the ejection media. In the meantime, the liquid ejection head of this embodiment can also be used in various applications other than image formation by using any of blood, cells in culture, and the like as the ejection media. The liquid ejection head is also adaptable to other applications including biochip fabrication, electronic circuit printing, and so forth.

Particularly, the mode of using water or a liquid similar to water as the first liquid (the bubbling medium) and a pigment ink having a higher viscosity than that of water as the second liquid (the ejection medium), and ejecting only the second liquid is one of effective usages of this embodiment. In this case as well, it is effective to suppress the water phase thickness ratio $h_r$ by setting the flow rate ratio $Q_r = Q_2/Q_1$ as low as possible as shown in FIG. 5A. Since there are no restrictions regarding the second liquid, the second liquid may adopt the same liquid as one of those cited as the examples of the first liquid. For instance, even if both of the two liquids are inks each containing a large amount of water, it is still possible to use one of the inks as the first liquid and the other ink as the second liquid depending on situations such as a mode of usage.

(Ejection Medium that Require Parallel Flows of Two Liquids)

In the case where the liquid to be ejected has been determined, the necessity of causing the two liquids to flow in the liquid flow passage (the pressure chamber) in such a way as to form the parallel flows may be determined based on the critical pressure of the liquid to be ejected. For example, the second liquid may be determined as the liquid to be ejected while the bubbling material serving as the first liquid may be prepared only in the case where the critical pressure of the liquid to be ejected is insufficient.

Figure 12A:
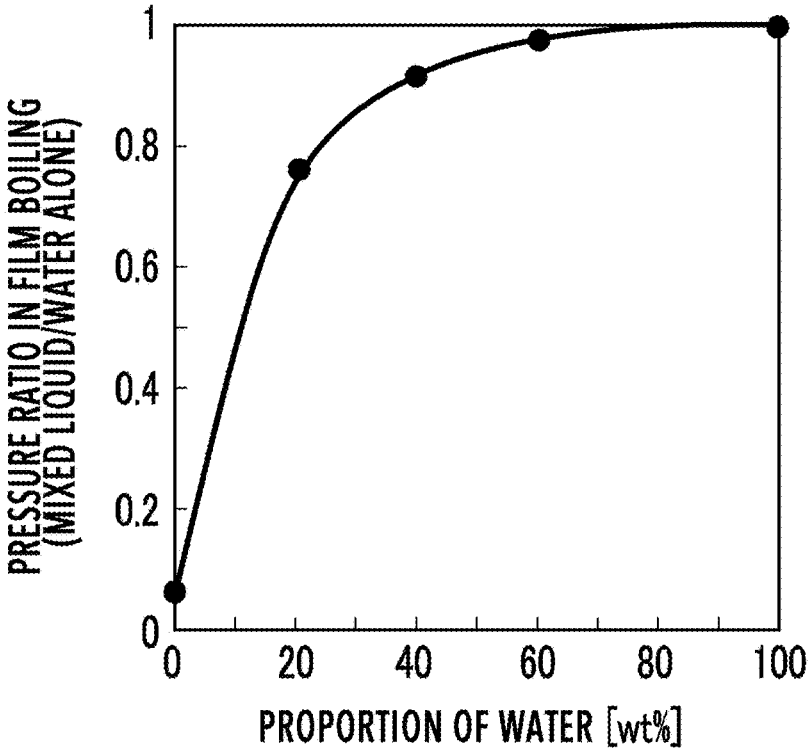
FIGS. 12A and 12B are graphs representing relations between a water content rate and a bubbling pressure.
Figure 12B:
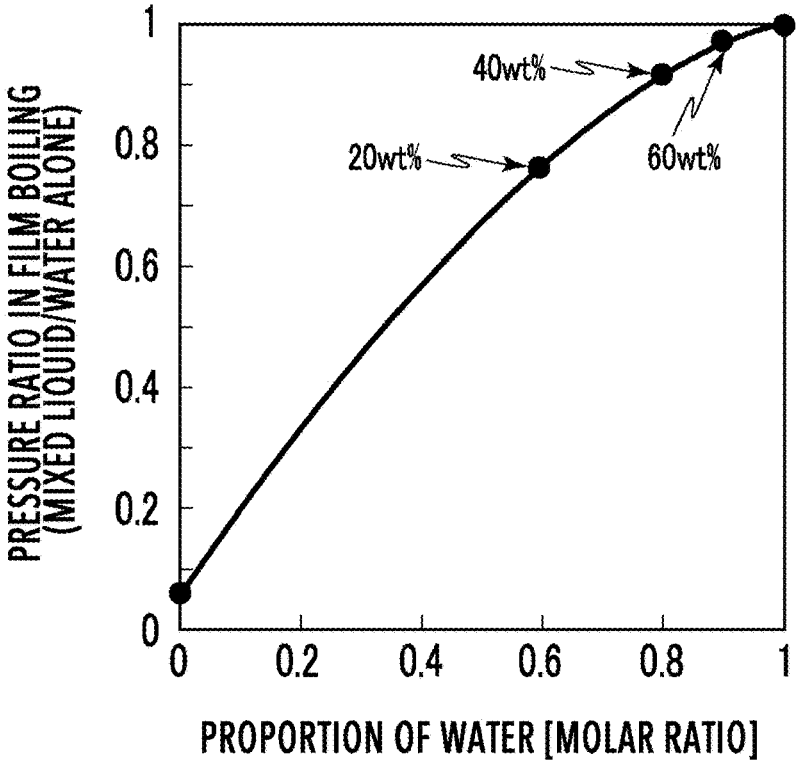

FIGS. 12A and 12B are graphs representing relations between a water content rate and a bubbling pressure at the time of the film boiling in the case where diethylene glycol (DEG) is mixed with water. The horizontal axis in FIG. 12A indicates a mass ratio (in percent by mass) of water relative to the liquid, and the horizontal axis in FIG. 12B indicates a molar ratio of water relative to the liquid.

As apparent from FIGS. 12A and 12B, the bubbling pressure at the time of the film boiling becomes lower as the water content rate (content percentage) is lower. In other words, the bubbling pressure is reduced more as the water content rate becomes lower, and ejection efficiency is deteriorated as a consequence. Nonetheless, the molecular weight of water (18) is substantially smaller than the molecular weight of diethylene glycol (106). Accordingly, even if the mass ratio of water is around 40 wt %, its molar ratio is about 0.9 and the bubbling pressure ratio is kept at 0.9. On the other hand, if the mass ratio of water falls below 40 wt %, the bubbling pressure ratio sharply drops together with the molar concentration as apparent from FIGS. 12A and 12B.

As a consequence, in the case where the mass ratio of water falls below 40 wt %, it is preferable to prepare the first liquid separately as the bubbling medium and to form the parallel flows of these two liquids in the liquid flow passage (the pressure chamber). As described above, in the case where the liquid to be ejected has been determined, the necessity of forming the parallel flows in the flow passage (the pressure chamber) can be determined based on the critical pressure of the liquid to be ejected (or on the bubbling pressure at the time of the film boiling).

(Ultraviolet Curable Ink as Example of Ejection Medium)

A preferable composition of an ultraviolet curable ink that can be used as the ejection medium in this embodiment will be described as an example. The ultraviolet curable ink is of a 100-percent solid type. Such ultraviolet curable inks can be categorized into an ink formed from a polymerization reaction component without a solvent, and an ink containing either water being of a solvent type or a solvent as a diluent. The ultraviolet curable inks actively used in recent years are 100-percent solid ultraviolet curable inks formed from non-aqueous photopolymerization reaction components (which are either monomers or oligomers) without containing any solvents. As for the composition, the typical ultraviolet curable ink contains monomers as a main component, and also contains small amounts of a photopolymerization initiator, a coloring material, and other additives including a dispersant, a surfactant, and the like. Broadly speaking, the components of this ink include the monomers in a range from 80 to 90 wt %/o, the photopolymerization initiator in a range from 5 to 10 wt %, the coloring material in a range from 2 to 5 wt %, and other additives for the rest. As described above, even in the case of the ultraviolet curable ink that has been hardly handled by the conventional thermal head, it is possible to use this ink as the ejection medium in this embodiment and to eject the ink out of the liquid ejection head by conducting the stable ejection operation. This makes it possible to print an image that is excellent in image robustness as well as abrasion resistance as compared to the related art.

(Example of Using Mixed Liquid as Ejected Droplet)

Next, a description will be given of a case of ejection of the ejected droplet 30 in the state where the first liquid 31 and the second liquid 32 are mixed at a predetermined ratio. For instance, in the case where the first liquid 31 and the second liquid 32 are inks having colors different from each other, these inks form laminar flows without being mixed in the liquid flow passage 13 and the pressure chamber 18 as long as the liquids satisfy a relation in which the Reynolds number calculated based on the viscosities and the flow rates of the two liquids is smaller than a predetermined value. In other words, by controlling the flow rate ratio $Q_r$ between the first liquid 31 and the second liquid 32 in the liquid flow passage and the pressure chamber, it is possible to adjust the water phase thickness ratio $h_r$ and therefore a mixing ratio between the first liquid 31 and the second liquid 32 in the ejected droplet to a desired ratio.

For example, assuming that the first liquid is a clear ink and the second liquid is cyan ink (or magenta ink), it is possible to eject light cyan ink (or light magenta ink) at various concentrations of the coloring material by controlling the flow rate ratio $Q_r$. Alternatively, assuming that the first liquid is yellow ink and the second liquid is magenta, it is possible to eject red ink at various color phase levels that are different stepwise by controlling the flow rate ratio $Q_r$. In other words, if it is possible to eject the droplet prepared by mixing the first liquid and the second liquid at the desired mixing ratio, then a range of color reproduction expressed on a print medium can be expanded more than the related art by appropriately adjusting the mixing ratio.

Moreover, the configuration of this embodiment is also effective in the case of using two types of liquids that are desired to be mixed together immediately after the ejection instead of mixing the liquids immediately before the ejection. For example, there is a case in image printing where it is desirable to deposit a high-density pigment ink with excellent chromogenic properties and a resin emulsion (resin EM) excellent in image robustness such as abrasion resistance on a print medium at the same time. However, a pigment component contained in the pigment ink and a solid component contained in the resin EM tend to develop agglomeration at a close interparticle distance, thus causing deterioration in dispersibility. In this regard, if the high-density EM (emulsion) is used as the first liquid of this embodiment while the high-density pigment ink is used as the second liquid thereof and the parallel flows are formed by controlling the flow velocities of these liquids, then the two liquids are mixed with each other and agglomerated together on the printing medium after being ejected. In other words, it is possible to maintain a desirable state of ejection under high dispersibility and to obtain an image with high chromogenic properties as well as high robustness after deposition of the droplets.

Note that in the case where the mixture after the ejection is intended as mentioned above, this embodiment exerts an effect of generating the flows of the two liquids in the pressure chamber regardless of the mode of the pressure generation element. In other words, this embodiment also functions effectively in the case of a configuration to use a piezoelectric element as the pressure generation element, for instance, where the limitation in the critical pressure or the problem of the scorch is not concerned in the first place.

As described above, according to this embodiment, it is possible to conduct the ejection operation favorably and stably by driving the pressure generation element 12 in the state where the first liquid and the second liquid are caused to flow steadily while keeping the predetermined water phase thickness ratio $h_r$ in the liquid flow passage (the pressure chamber).

By driving the pressure generation element 12 in the state where the liquids are caused to flow steadily, the stable interface can be formed at the time of ejecting the liquids. If the liquids are not flowing during the ejection operation of the liquids, the interface is prone to be disturbed as a consequence of generation of the bubble, and the printing quality may also be affected in this case. By driving the pressure generation element 12 while allowing the liquids to flow as described in this embodiment, it is possible to suppress the turbulence of the interface due to the generation of the bubble. Since the stable interface is formed, the content rate of various liquids contained in the ejected liquid is stabilized and the printing quality is also improved, for example. Moreover, since the liquids are caused to flow before driving the pressure generation element 12 and to flow continuously even during the ejection, it is possible to reduce time for forming the meniscus again in the liquid flow passage (the pressure chamber) after the ejection of the liquids. Meanwhile, the flows of the liquids are created by using a pump or the like loaded in the liquid circulation unit 504 before the driving signal is inputted to the pressure generation element 12. As a consequence, the liquids are flowing at least immediately before the ejection of the liquids.

The first liquid and the second liquids flowing in the pressure chamber may be circulated between the pressure chamber and an outside unit. If the circulation is not conducted, a large amount of any of the first liquid and the second liquid having formed the parallel flows in the liquid flow passage and the pressure chamber but having not been ejected would remain inside. Accordingly, the circulation of the first liquid and the second liquid with the outside unit makes it possible to use the liquids that have not been ejected in order to form the parallel flows again.

Second Embodiment

This embodiment also uses the liquid ejection head 1 and the liquid ejection apparatus shown in FIGS. 1 to 3.

FIGS. 13A to 13D are diagrams showing a configuration of the liquid flow passage 13 of this embodiment. The liquid flow passage 13 of this embodiment is different from the liquid flow passage 13 described in the first embodiment in that a third liquid 33 is allowed to flow in the liquid flow passage 13 in addition to the first liquid 31 and the second liquid 32. By allowing the third liquid 33 to flow in the pressure chamber, it is possible to use the bubbling medium with the high critical pressure as the first liquid while using any of the inks of different colors, the high-density resin EM, and the like as the second liquid and the third liquid.

In this embodiment, the silicon substrate 15 corresponding to the bottom portion of the liquid flow passage 13 includes the second inflow port 21, a third inflow port 22, the first inflow port 20, the first outflow port 25, a third outflow port 27, and the second outflow port 26, which are formed in this order in the y direction. Moreover, the pressure chamber 18 including the ejection port 11 and the pressure generation element 12 is located substantially at the center between the first inflow port 20 and the first outflow port 25.

The first liquid 31 supplied to the liquid flow passage 13 through the first inflow port 20 flows in the y direction (the direction indicated with arrows) and then flows out of the first outflow port 25. Meanwhile, the second liquid 32 supplied to the liquid flow passage 13 through the second inflow port 21 flows in the y direction (the direction indicated with arrows) and then flows out of the second outflow port 26. The third liquid 33 supplied to the liquid flow passage 13 through the third inflow port 22 flows in the y direction (the direction indicated with arrows) and then flows out of the third outflow port 27. That is to say, in the liquid flow passage 13, all of the first liquid 31, the second liquid 32, and the third liquid 33 flow in the y direction in the section between the first inflow port 20 and the first outflow port 25. The pressure generation element 12 comes into contact with the first liquid 31 while the second liquid 32 exposed to the atmosphere forms a meniscus in the vicinity of the ejection port 11. The third liquid 33 flows between the first liquid 31 and the second liquid 32.

Figure 13A:
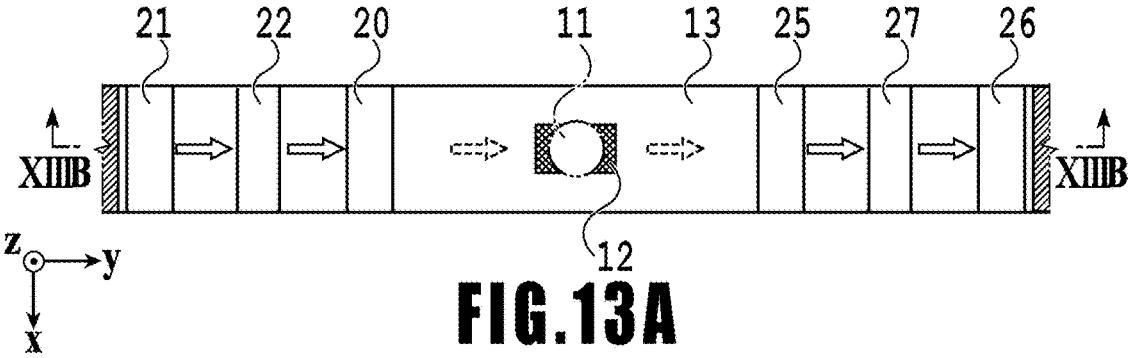
FIGS. 13A to 13D illustrate enlarged details of a liquid flow passage and a pressure chamber in a second embodiment.
Figure 13B:
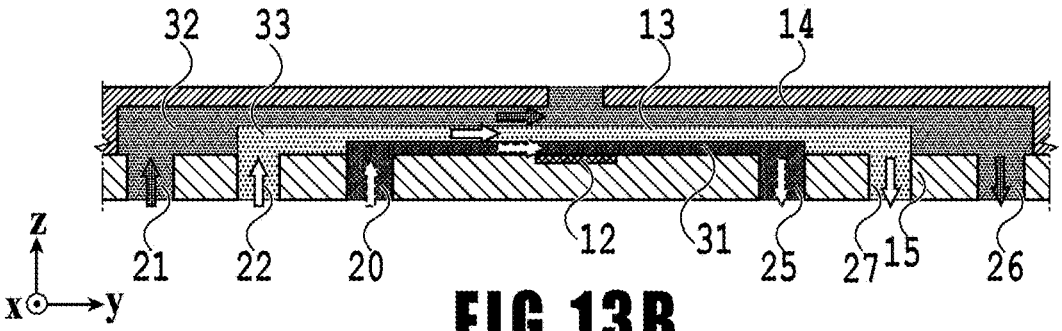
Figure 13C:
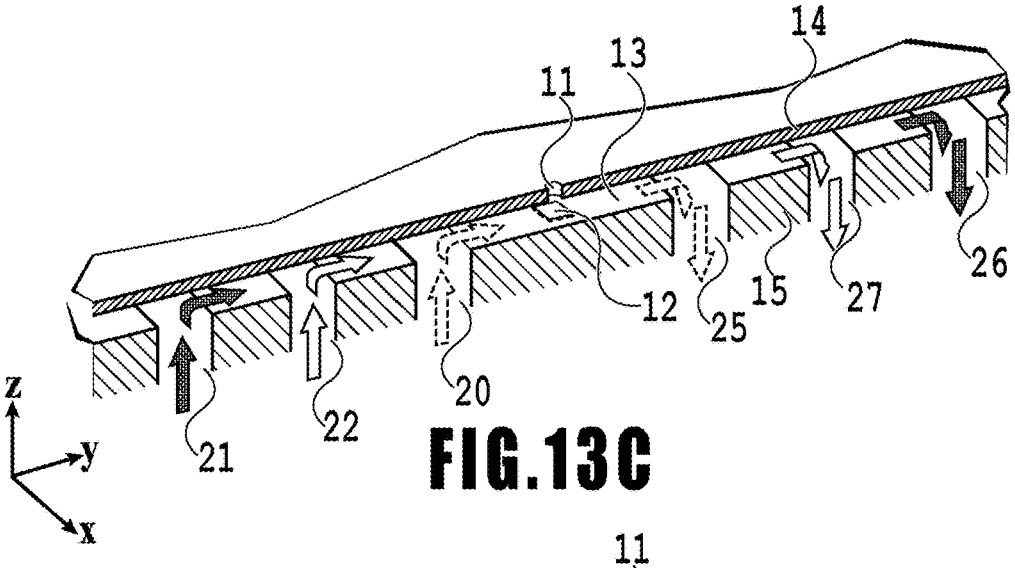
Figure 13D:
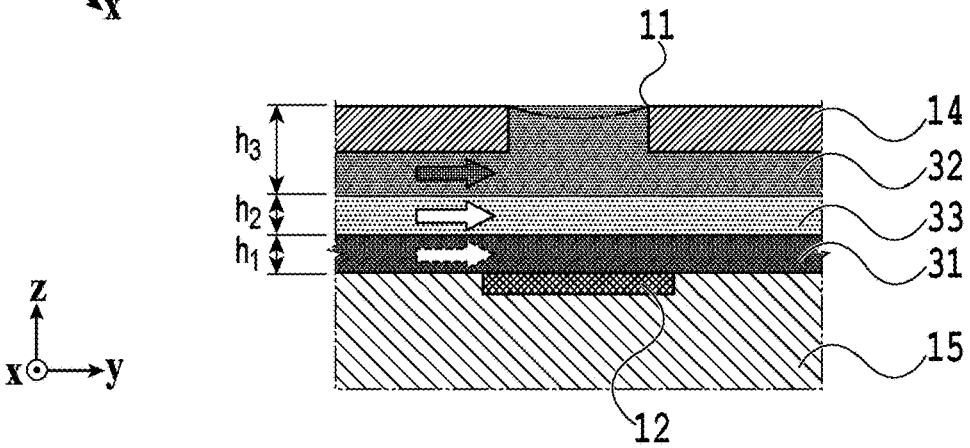

In this embodiment, the CPU 500 controls the flow rate $Q_1$ of the first liquid 31, the flow rate $Q_2$ of the second liquid 32, and a flow rate $Q_3$ of the third liquid 33 by using the liquid circulation unit 504, and forms three-layered parallel flows steadily as shown in FIG. 13D. Then, in the state where the three-layered parallel flows are formed as described above, the CPU 500 drives the pressure generation element 12 of the liquid ejection head 1 and ejects the droplet from the ejection port 11. In this way, even if the position of each interface is disturbed along with the ejection operation, the three-layered parallel flows are recovered in a short time as shown in FIG. 13D so that the next ejection operation can be started right away. As a consequence, it is possible to maintain the good ejection operation of the droplet containing the first to third liquids at the predetermined ratio and to obtain a fine output product.

Third Embodiment

A third embodiment will be described with reference to FIGS. 14 to 17B. Note that the same constituents as those in the first embodiment will be denoted by the same reference numerals and the explanations thereof will be omitted. This embodiment is characterized in that the pressure generation element 12 is driven in the state where the first liquid and the second liquid flow side by side in the x direction inside the pressure chamber 18. This embodiment also uses the liquid ejection head 1 and the liquid ejection apparatus shown in FIGS. 1 and 2.

Figure 14:
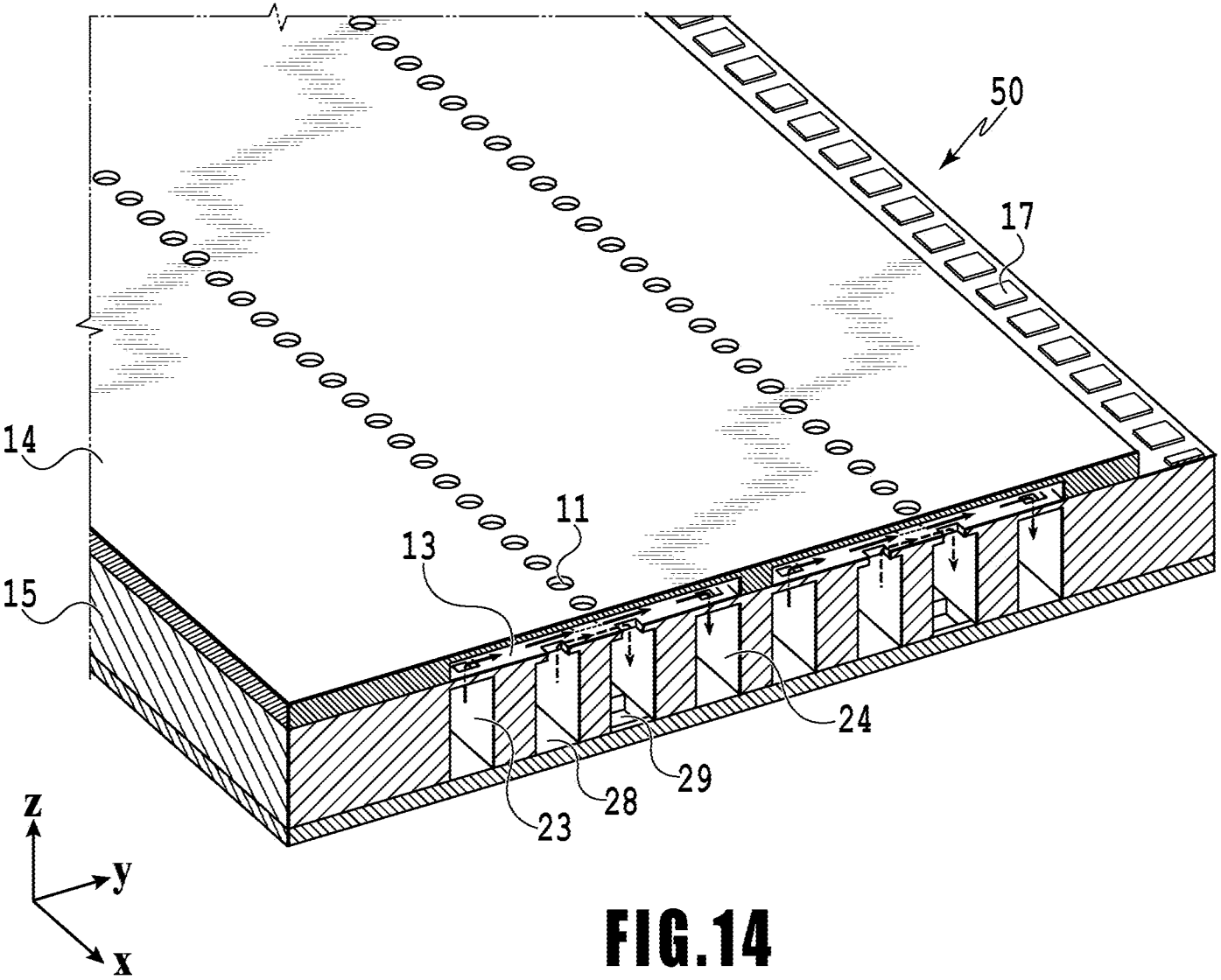
FIG. 14 is a cross-sectional perspective view of an element board in a third embodiment.
Figure 15A:
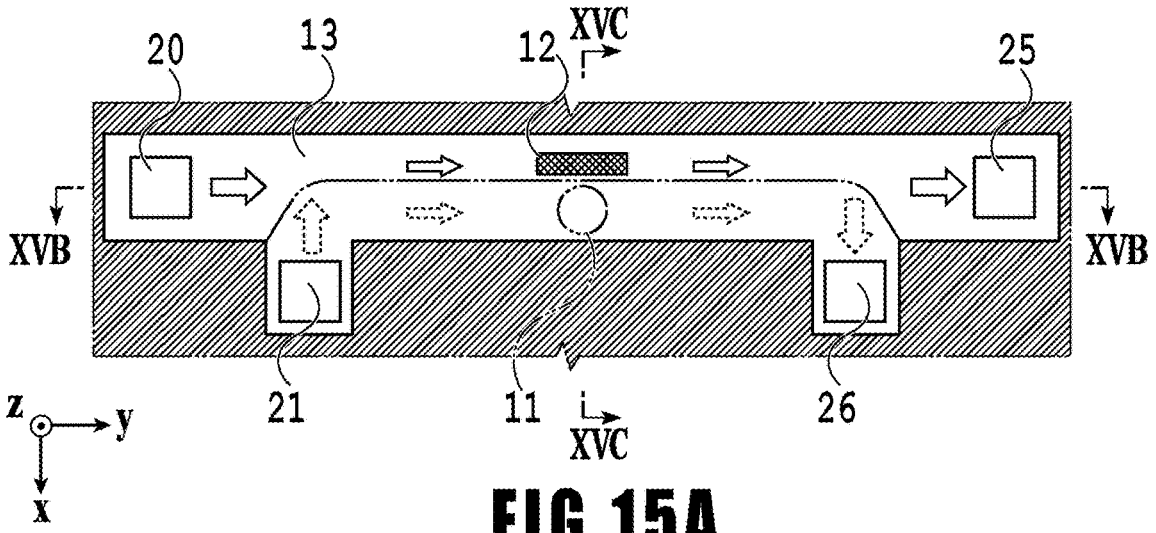
FIGS. 15A to 15C illustrate enlarged details of a liquid flow passage and a pressure chamber in the third embodiment.
Figure 15B:
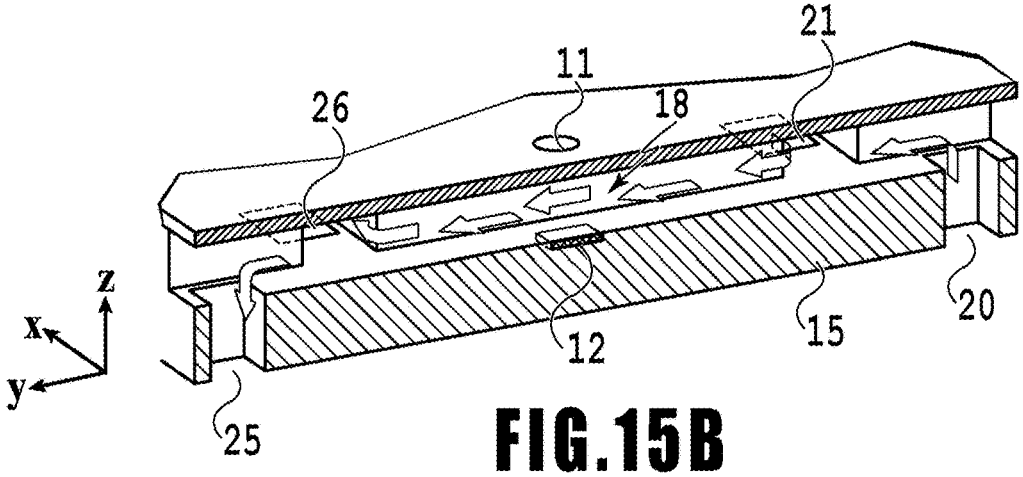

FIG. 14 is a cross-sectional perspective view of an element board 50 in this embodiment. Although the element board 50 actually has structures shown in FIGS. 15A and 15B, FIG. 14 illustrates the element board 50 while partially omitting structures around the second inflow port 21 and the second outflow port 26 in order to describe a broad outline of the flows in the element board 50. The first common supply flow passage 23, the first common collection flow passage 24, the second common supply flow passage 28, and the second common collection flow passage 29 are connected to the liquid flow passage 13 in common. In this embodiment as well, the flows of the liquids in the first common supply flow passage 23, the first common collection flow passage 24, the second common supply flow passage 28, and the second common collection flow passage 29 are controlled by the liquid circulation unit 504 described with reference to FIG. 1. To be more precise, the liquid circulation unit 504 performs the control such that the first liquid flowing into the liquid flow passage 13 from the first common supply flow passage 23 is directed to the first common collection flow passage 24 while the second liquid flowing into the liquid flow passage 13 from the second common supply flow passage 28 is directed to the second common collection flow passage 29.

(Configuration of Liquid Flow Passage in Third Embodiment)

Figure 15C:
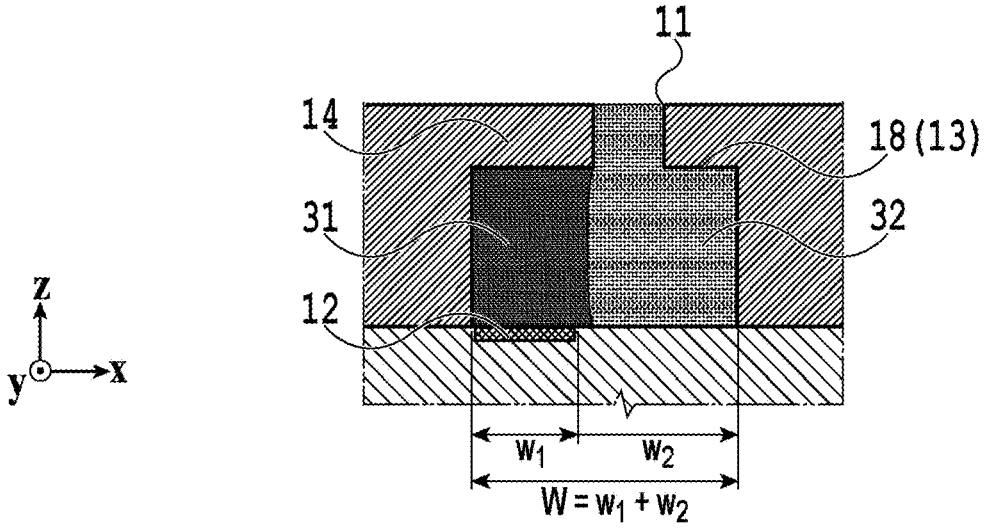
Figure 16A:
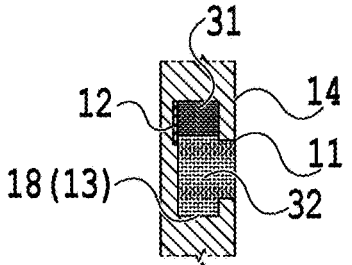
FIGS. 16A to 16H are diagrams schematically illustrating states of ejection in the third embodiment.
Figure 16B:
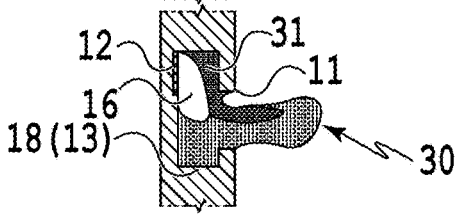
Figure 16C:
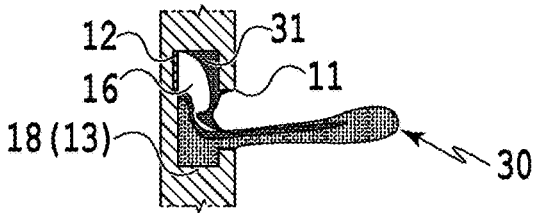
Figure 16D:
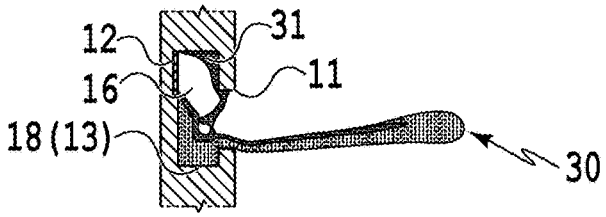
Figure 16E:
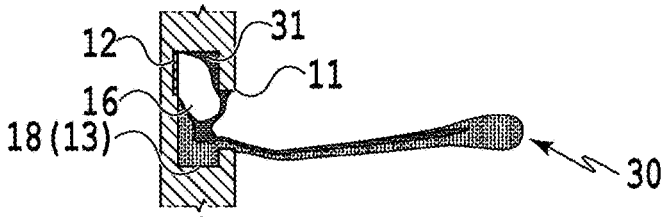
Figure 16F:
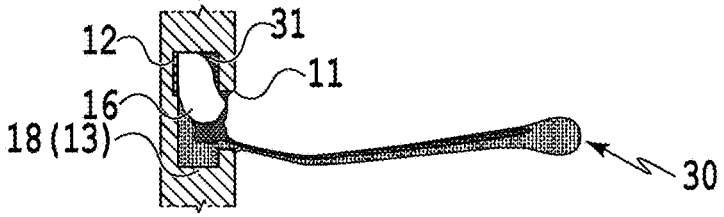
Figure 16G:
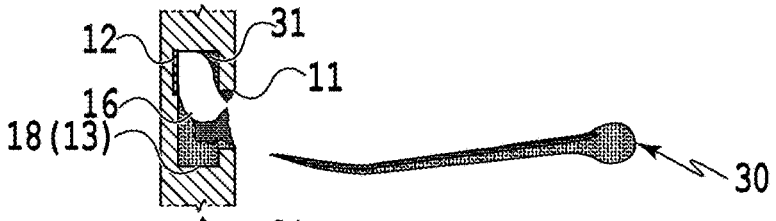
Figure 16H:
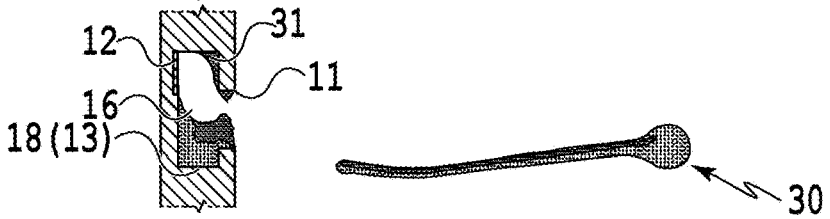

FIGS. 15A to 15C are diagrams for describing details of one of the liquid flow passages 13 formed in the silicon substrate 15. FIG. 15A is a perspective view of the liquid flow passage viewed from the ejection port 11 side (the +z direction side) and FIG. 15B is a perspective view illustrating a cross-section taken along the XVB line in FIG. 15A. Moreover, FIG. 15C is an enlarged diagram of a cross-section taken along the XVC line in FIG. 15A.

The silicon substrate 15 includes the first inflow port 20, the second inflow port 21, the second outflow port 26, and the first outflow port 25, which are formed in this order in the y direction. Moreover, the first inflow port 20 and the second inflow port 21 are formed in the silicon substrate 15 at positions shifted from each other in the x direction. Likewise, the second outflow port 26 and the first outflow port 25 are formed in the silicon substrate 15 at positions shifted from each other in the x direction. The first inflow port 20 is connected to the first common supply flow passage 23, the first outflow port 25 is connected to the first common collection flow passage 24, the second inflow port 21 is connected to the second common supply flow passage 28, and the second outflow port 26 is connected to the second common collection flow passage 29, respectively (see FIG. 14).

According to the above-described configuration, the first liquid 31 supplied from the first common supply flow passage 23 to the liquid flow passage 13 through the first inflow port 20 flows in the y direction (indicated with arrows in solid lines) and is then collected from the first outflow port 25 into the first common collection flow passage 24. Meanwhile, the second liquid 32 supplied from the second common supply flow passage 28 to the liquid flow passage 13 once flows in the −x direction and then flows while changing its direction to the y direction (indicated with arrows in dashed lines). Thereafter, the second liquid 32 is collected from the second outflow port 26 into the second common collection flow passage 29.

At a position on an upstream side in the y direction of the second inflow port 21, the first liquid that flows in from the first inflow port 20 occupies the entire region in a width direction (the x direction). By causing the second liquid 32 to flow once in the −x direction from the second inflow port 21, it is possible to partially thrust the flow of the first liquid 31 so as to reduce the width of this flow. As a consequence, it is possible to establish the state where the first liquid 31 and the second liquid 32 flow side by side in the x direction in the liquid flow passage as shown in FIGS. 15A and 15C.

Here, the pressure generation element 12 and the ejection port 11 are formed in such a way as to be shifted from each other in the x direction. To be more precise, the pressure generation element 12 is formed at a position shifted from the ejection port 11 toward the flow of the first liquid 31. As a consequence, the first liquid 31 mainly flows on the pressure generation element 12 side while the second liquid 32 mainly flows on the ejection port 11 side. Accordingly, by applying the pressure to the first liquid 31 by using the pressure generation element 12, it is possible to eject the second liquid, which is pressurized through the interface, out of the ejection port 11.

In this embodiment, the flow rate of the first liquid 31 and the flow rate of the second liquid 32 are adjusted in accordance with the physical properties of the first liquid 31 and the physical properties of the second liquid 32 such that the first liquid 31 flows on the pressure generation element 12 and the second liquid 32 flows on the ejection port 11 as mentioned above.

(Theoretical Conditions to Form Parallel Flows in State of Laminar Flows in Third Embodiment)

Next, conditions to form the parallel flows in which the first liquid and the second liquid flow side by side in the x direction will be described with reference to FIG. 15C. In FIG. 15C, a distance in the x direction of the liquid flow passage 13 (a width of the flows) is defined as W. Meanwhile, a distance from a wall surface of the liquid flow passage 13 to the liquid-liquid interface between the first liquid 31 and the second liquid 32 (the water phase thickness of the second liquid) is defined as $w_2$, and a distance from the liquid-liquid interface to an opposite wall surface of the liquid flow passage (the water phase thickness of the first liquid) is defined as $w_1$. These definitions bring about $W=w_1+w_2$. Now, as for the boundary conditions in the liquid flow passage 13 and the pressure chamber 18, the velocities of the liquids on the wall surfaces of the liquid flow passage 13 and the pressure chamber 18 are assumed to be zero, and the velocities and the shear stresses of the first liquid 31 and the second liquid 32 at the liquid-liquid interface are assumed to have continuity as with the first embodiment. Based on the assumption, if the first liquid 31 and the second liquid 32 form the parallel steady flows that flow side by side in the x direction, then the quartic equation described earlier in the (formula 2) holds true in the section of the parallel flows. In this embodiment, the value H shown in the (formula 2) corresponds to the value W, the value $h_1$ therein corresponds to the value $w_1$, and the value $h_2$ therein corresponds to the value $w_2$, respectively. Therefore, as with the first embodiment, it is possible to adjust the water phase thickness ratio $h_r=w_1/(w_1+w_2)$ based on the viscosity ratio $\eta_r=\eta_2/\eta_1$ and the flow rate ratio $Q_r=Q_2/Q_1$, which are the ratios of the viscosity $\eta_1$ and the flow rate $Q_1$ of the first liquid to the viscosity $\eta_2$ and the flow rate $Q_2$ of the second liquid. Moreover, as with the first embodiment, in order to establish the state where the first liquid and the second liquid flow in the liquid flow passage 13 while defining the interface therebetween, it is necessary to satisfy the flow rate ratio $Q_r=Q_2/Q_1>0$, or in other words, to satisfy $Q_1>0$ and $Q_2>0$.

(Transitional States in Ejection Operation in Third Embodiment)

Next, transitional states in the ejection operation in the third embodiment will be described with reference to FIGS. 16A to 16H. FIGS. 16A to 16H are diagrams schematically illustrating transitional states in the case of carrying out the ejection operation in a state of causing the first liquid and the second liquid with the viscosity ratio $\eta_r=4$ to flow in the liquid flow passage 13 having the height of the flow passage (a length in the z direction) of H [μm]=20 μm with the thickness of the orifice plate set to T=6 μm. FIGS. 16A to 16H illustrate a sequence of the ejection process with the lapse of time. Here, only the first liquid 31 is brought into contact with an effective region of the pressure generation element 12 by adjusting layer thicknesses of the first liquid 31 and the second liquid 32. In the meantime, the inside of the ejection port 11 is filled only with the second liquid 32.

If the ejection operation is carried out in this state, the bubble is generated from the first liquid 31 in contact with the pressure generation element 12 and the bubble 16 thus generated can eject the liquid from the ejection port 11. Although the second liquid 32 filling the ejection port is dominant in the ejected droplet 30, the ejected droplet 30 also contains a certain amount of the first liquid 31 that is pushed out by this bubble 16. The amount of the first liquid 31 to be pushed out by the bubble 16 is adjustable by changing the water phase thickness ratio $h_r$.

Figure 17A:
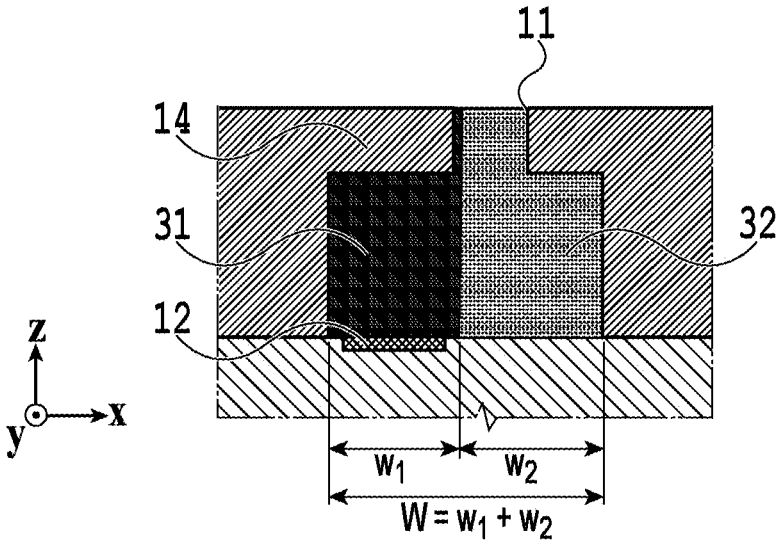
FIGS. 17A and 17B are diagrams illustrating a case of changing the water phase thickness ratio in the third embodiment.
Figure 17B:
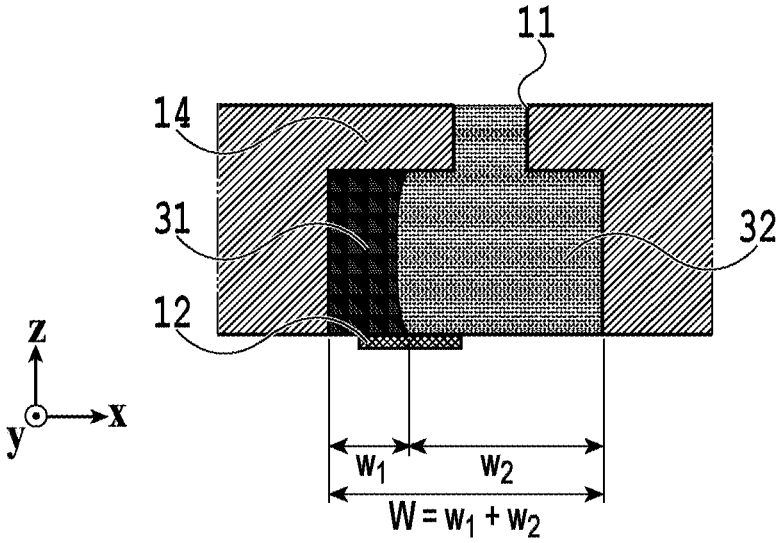

Next, the ratio between the first liquid and the second liquid contained in the ejected droplet will be described with reference to FIGS. 17A and 17B. The water phase thickness $w_1$ of the first liquid 31 is smaller as the water phase thickness ratio $h_r$ ($=w_1/(w_1+w_2)$) is closer to 0 and the water phase thickness $w_1$ of the first liquid 31 is larger as the water phase thickness ratio $h_r$ is closer to 1. As the water phase thickness ratio $h_r$ is closer to 0, the amount of the first liquid 31 to be pushed out by the bubble 16 becomes less. Accordingly, the ejected droplet 30 mainly contains the second liquid 32 that occupies the inside of the ejection port 11. On the other hand, in the case where the water phase thickness ratio $h_r$ is reasonably large, the first liquid starts entering the ejection port 11 as shown in FIG. 17A and the amount of the first liquid 31 to be pushed out by the bubble 16 is increased as well. As a consequence, the percentage of the first liquid 31 contained in the ejected droplet 30 is increased. Note that FIG. 17A illustrates the simplified interface between the first liquid 31 and the second liquid 32.

As described above, the ratio between the first liquid 31 and the second liquid 32 contained in the ejected droplet 30 varies with the water phase thickness ratio $h_r$ in the liquid flow passage 13. In the case where the first liquid 31 is used as the bubbling medium and the second liquid 32 is expected to be the main component of the ejected droplet 30, for example, the water phase thickness ratio $h_r$ needs to be adjusted such that the ejection port 11 is filled only with the second liquid as shown in FIG. 15C. However, if the water phase thickness ratio $h_r$ is set too low, a percentage of the pressure generation element 12 to come into contact with the second liquid 32 is increased as shown in FIG. 17B, which leads to a concern of instability of the bubbling due to adhesion of a scorched portion of the second liquid 32 to the pressure generation element 12. Moreover, if the contact area of the pressure generation element 12 with the first liquid 31 is reduced, the bubbling energy is diminished whereby the ejection efficiency is reduced, thus leading to a concern of the occurrence of adverse effects associated therewith. Accordingly, in order to retain the stable ejection, it is necessary to suppress the amount of the second liquid 32 in contact with the pressure generation element 12 by adjusting the water phase thickness ratio $h_r$.

Fourth Embodiment

Figure 18A:
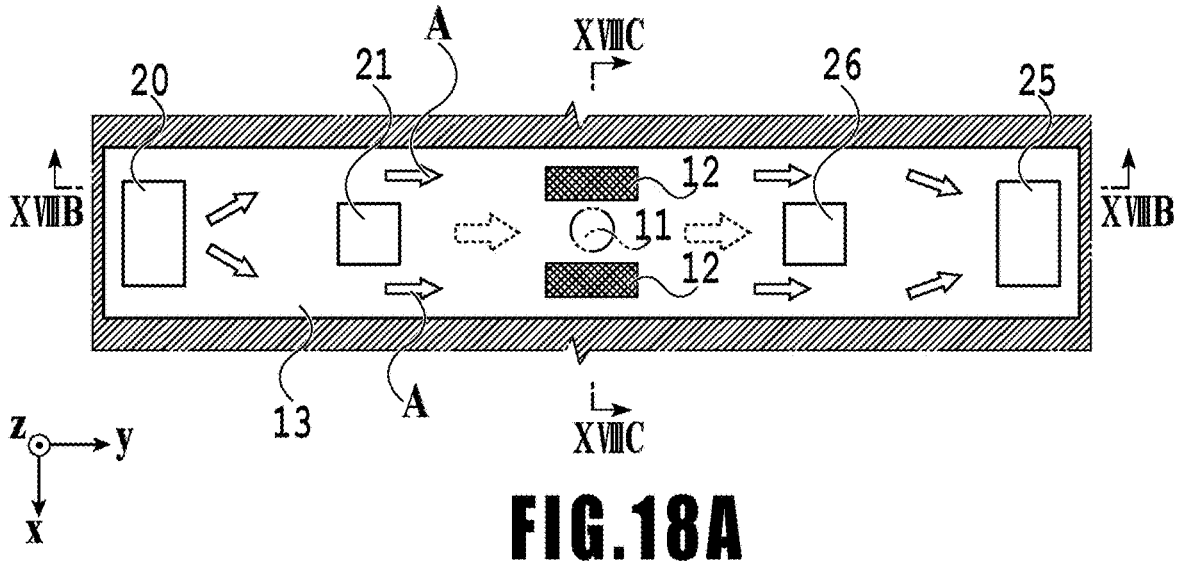
FIGS. 18A to 18C illustrate enlarged details of a liquid flow passage and a pressure chamber in a fourth embodiment.
Figure 18B:
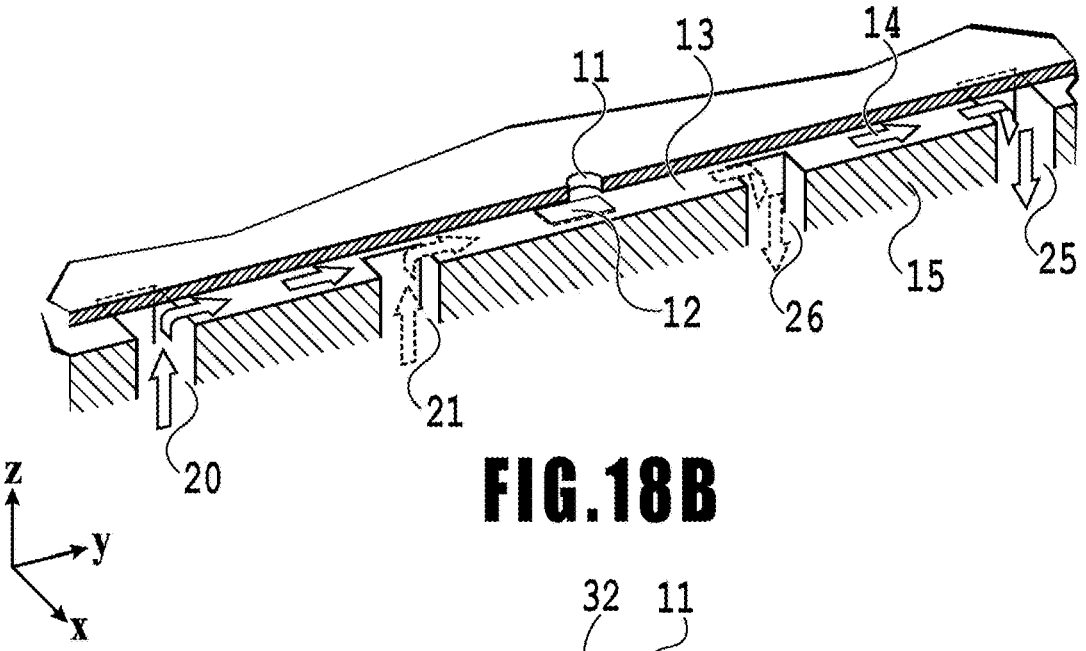
Figure 18C:
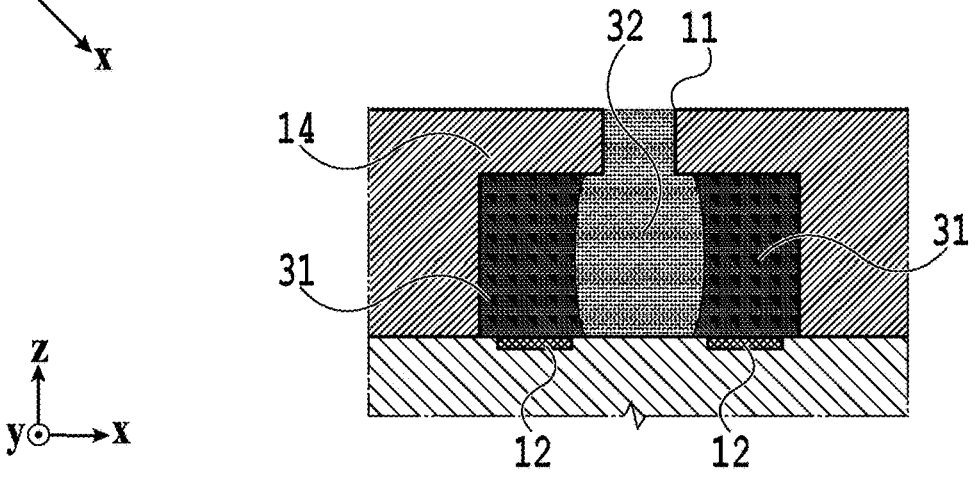

A fourth embodiment will be described with reference to FIGS. 18A to 18C and FIGS. 19A to 19C. Note that the same constituents as those in the first embodiment will be denoted by the same reference numerals and the explanations thereof will be omitted. This embodiment is characterized in that the first liquid 31 and the second liquid 32 flow in such a way that the second liquid 32 is sandwiched by layers of the first liquid 31. This embodiment also uses the liquid ejection head 1 and the liquid ejection apparatus shown in FIGS. 1 and 2. FIG. 18A is a perspective view of the liquid flow passage of this embodiment viewed from the ejection port 11 side (the +z direction side) and FIG. 18B is a perspective view illustrating a cross-section taken along the XVIIIB line in FIG. 18A. Moreover, FIG. 18C is an enlarged diagram of a cross-section taken along the XVIIIC line in FIG. 18A.

In this embodiment, in the case where the first liquid 31 flows from the first inflow port 20 into the liquid flow passage 13 and meets the second liquid 32 that flows in from the second inflow port 21, the first liquid 31 flows between the second liquid 32 and the walls of the flow passages in such a way as to bypass the flow of the second liquid as indicated with arrows A in FIG. 18A. The second liquid 32 flows from the second inflow port 21 toward the second outflow port 26. As a consequence, liquid-liquid interfaces are formed in the order of the first liquid 31, the second liquid 32, and the first liquid 31 from one of the walls of the flow passage such that the second liquid 32 is sandwiched by the layers the first liquid 31 as shown in FIG. 18C. The pressure generation elements 12 are arranged on the silicon substrate 15 in such a way as to be symmetrical in the x direction with respect to the ejection port 11. Thus, the two pressure generation elements 12 come into contact with the respective layers of the first liquid 31 while the ejection port 11 is mainly filled with the second liquid 32. If the pressure generation elements 12 are driven in this state, the first liquid 31 in contact with the respective pressure generation elements 12 forms bubbles so as to eject the droplet mainly containing the second liquid 32 out of the ejection port. In the meantime, since the pressure generation elements 12 are symmetrically arranged with respect to the ejection port 11, it is possible to shoot the ejected droplet 30 in the symmetric shape in the x direction so as to enable high-quality printing. According to the forms of interfaces illustrated in FIG. 18C, the second liquid 32 is sandwiched by the layers of the first liquid 31. In this regard, the relation between the water phase thickness and the flow rate as defined in the (formula 2) does not apply to this configuration in a strict sense. Nonetheless, the water phase thickness tends to vary in proportion to the flow rate of each of the liquid phases. Specifically, if the phase thickness of the second liquid 32 needs to be increased in the case where the viscosity of the first liquid 31 is about the same as the viscosity of the second liquid 32, it is possible to change the phase thickness of the second liquid 32 thicker by increasing the flow rate ratio $Q_r$ as a consequence of increasing the flow rate of the second liquid 32.

Figure 19A:
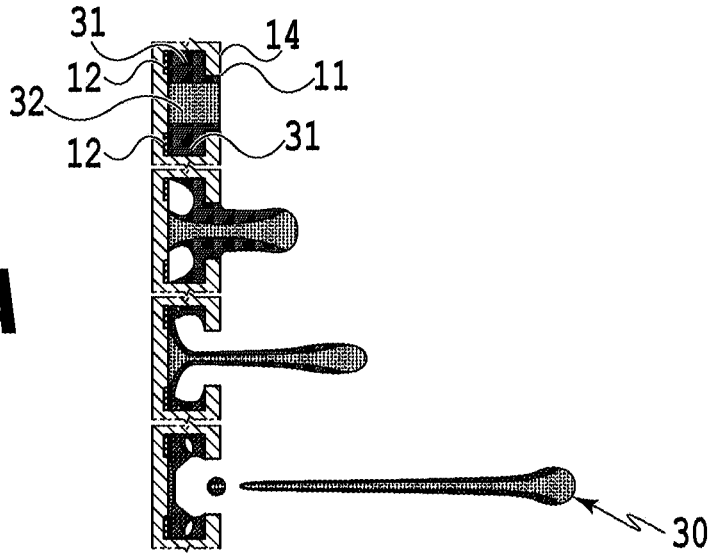
FIGS. 19A to 19C are state diagrams of ejection at various water phase thickness ratios in the fourth embodiment.
Figure 19B:
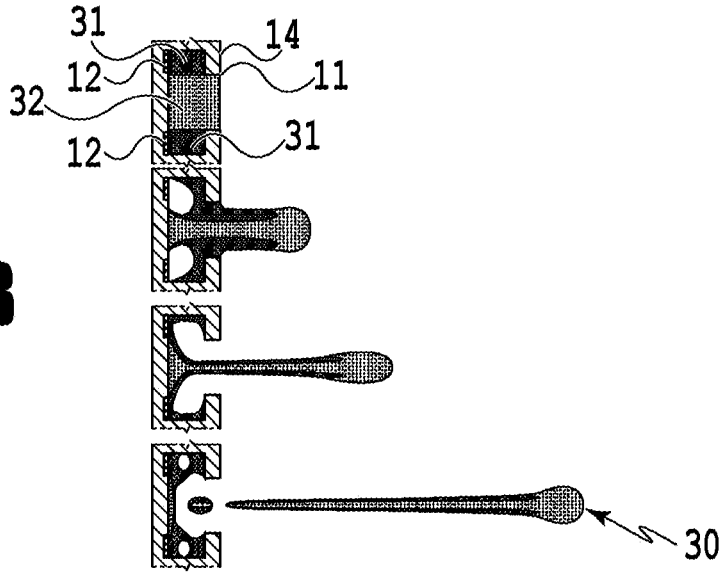
Figure 19C:
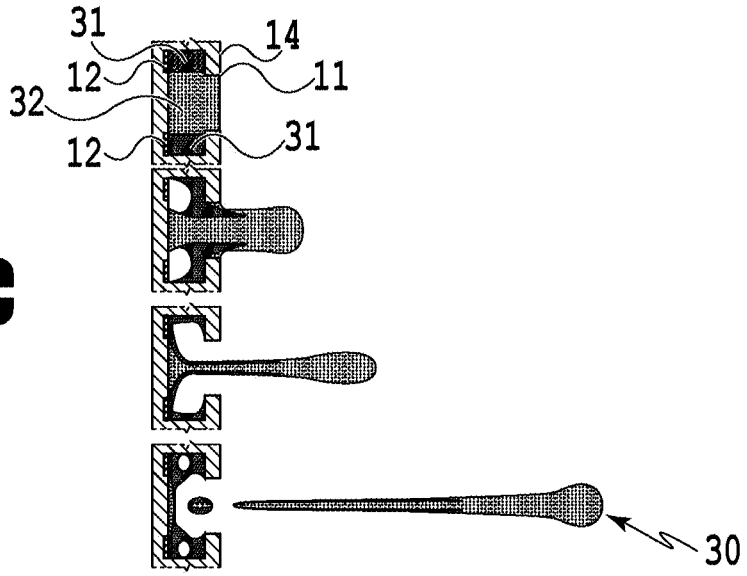

Next, an ejection process of the liquids in this embodiment will be described with reference to FIGS. 19A to 19C. FIGS. 19A to 19C are diagrams showing the ejection process in the case of changing the phase thickness ratio between the first liquid 31 and the second liquid 32 while setting the height of the flow passage to 14 μm, setting the thickness of the orifice plate to 6 μm, and setting a diameter of the ejection port to 10 μm. In each of FIGS. 19A to 19C, the ejection process with the lapse of time is illustrated from the top to the bottom.

FIG. 19A illustrates the ejection process in the case where the phase thickness of the second liquid 32 is adjusted to be smaller than 10 μm which is equivalent to the diameter of the ejection port. Both of the second liquid 32 and the first liquid 31 are present in the ejection port 11. If the ejection operation is carried out in this state, the liquids can be ejected by forming the bubbles of the first liquid 31 in contact with the pressure generation elements 12. Since both of the first liquid and the second liquid are present in the ejection port 11, the ejected droplet 30 is a mixed liquid of these liquids.

FIG. 19B illustrates the ejection process in the case where the phase thickness of the second liquid 32 is adjusted to coincide with the diameter of the ejection port equal to 10

μm. If the ejection operation is carried out in this state, the liquids can be ejected by forming the bubbles of the first liquid 31 in contact with the pressure generation elements. While the ejected droplet 30 mainly contains the second liquid 32 that occupies the inside of the ejection port, a portion of the first liquid 31 is also ejected as part of the ejected droplet as a consequence of bubbling. Therefore, this droplet is a mixed liquid of the second liquid with the first liquid at a smaller percentage than that in the case of FIG. 19A.

FIG. 19C illustrates the ejection process in the case where the phase thickness of the second liquid 32 is adjusted to 12 μm which is larger than the diameter of the ejection port 11. The pressure generation elements 12 are located at positions to come into contact only with the first liquid, so that the liquid can be ejected by generating the bubbles of the first liquid. A portion of the second liquid 32 inside the ejection port and around the ejection port is pushed out of the ejection port 11, whereby the ejected droplet 30 consists essentially of the second liquid 32. The percentage of the components in the ejected droplet 30 can be controlled by adjusting the phase thickness of the second liquid 32 as described above. Particularly, in the case of forming the ejected droplet 30 only from the second liquid, it is effective to set its phase thickness larger than the diameter of the ejection port as shown in FIG. 19C. However, if the second liquid 32 comes into contact with the pressure generation elements 12 as a consequence of the increase in phase thickness thereof, there is a concern of instability of the bubbling due to adhesion of a scorched portion of the second liquid 32 to any of the pressure generation elements 12. Moreover, if the contact area of each pressure generation element 12 with the first liquid 31 is reduced, the bubbling energy is diminished whereby the ejection efficiency is reduced, thus leading to a concern of the occurrence of adverse effects associated therewith. Accordingly, it is preferable to locate the position of each liquid-liquid interface between the second liquid 32 and the first liquid 31 at a position between the ejection port to the corresponding pressure generation element as shown in FIG. 19C.

Fifth Embodiment

Figure 20A:
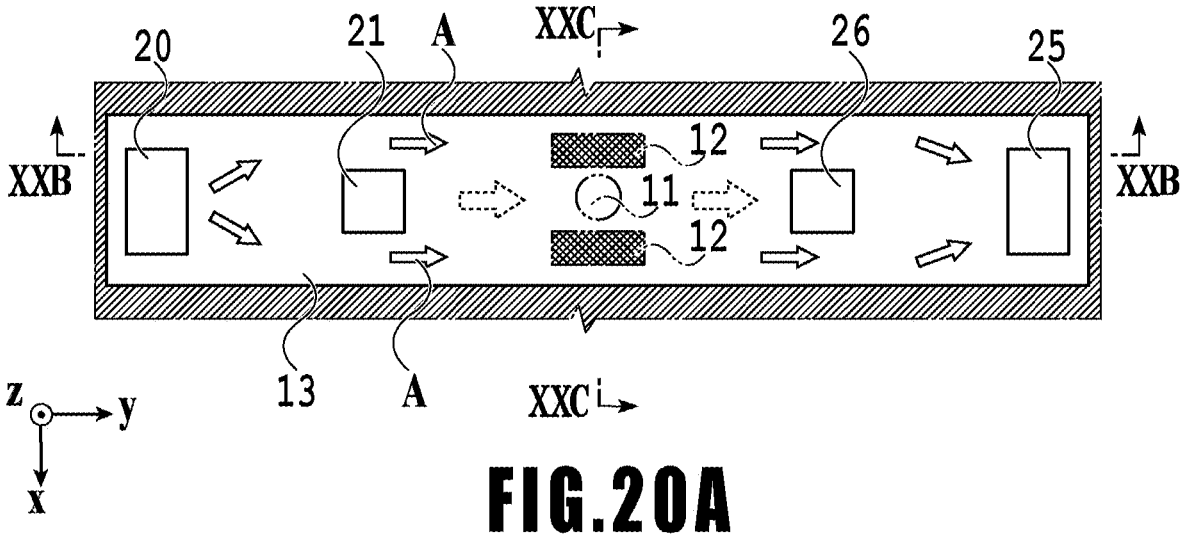
FIGS. 20A to 20C illustrate enlarged details of a liquid flow passage and a pressure chamber in a fifth embodiment.
Figure 20B:
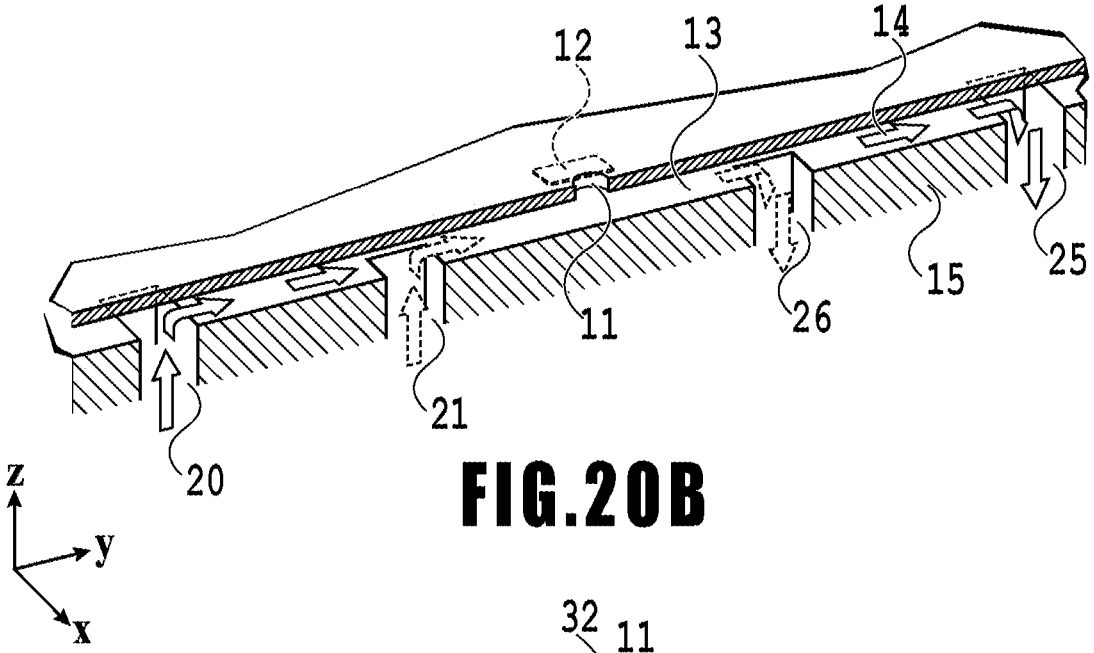
Figure 20C:
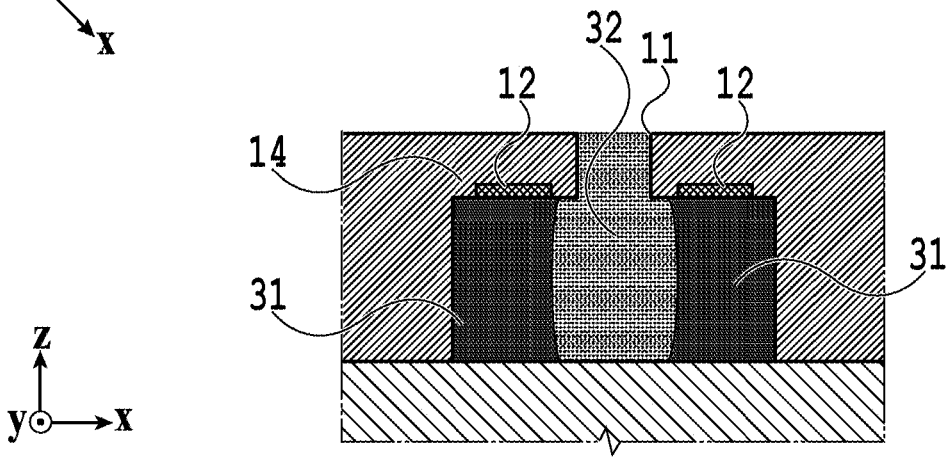

A fifth embodiment will be described with reference to FIG. 20 to 21B. Note that the same constituents as those in the first embodiment will be denoted by the same reference numerals and the explanations thereof will be omitted. This embodiment is characterized in that the first liquid 31 and the second liquid 32 flow in such a way that the second liquid 32 is sandwiched by the layers of the first liquid 31. In this case, two pressure generation elements 12 are provided on a wall surface close to the ejection port 11 instead of the wall surface close to the silicon substrate 15. FIG. 20A is a perspective view of the liquid flow passage 13 of this embodiment viewed from the ejection port 11 side (the +z direction side) and FIG. 20B is a perspective view illustrating a cross-section taken along the X×B line in FIG. 20A. Moreover, FIG. 20C is an enlarged diagram of a cross-section taken along the X×C line in FIG. 20A.

The difference between this embodiment and the fourth embodiment lies in the positions to locate the pressure generation elements 12. In this embodiment, the pressure generation elements 12 are arranged inside the pressure chamber 18 and at such positions on the orifice plate 14 that are symmetrical in the x direction with respect to the ejection port 11. As shown in FIG. 20C, the pressure generation elements 12 are in contact with the respective layers of the first liquid 31 while the ejection port 11 is mainly filled with the second liquid 32. If the pressure generation elements 12 are driven in this state, the first liquid 31 in contact with the pressure generation elements 12 forms bubbles so as to eject the droplet mainly containing the second liquid 32 out of the ejection port 11. Since the pressure generation elements 12 are symmetrically arranged with respect to the ejection port 11, it is possible to shoot the ejected droplet in the symmetric shape in the z direction so as to enable high-quality printing.

If the pressure generation elements 12 are provided on the silicon substrate 15 as in the fourth embodiment, there is a case where the pressure at the time of generation of the bubbles in the first liquid is not sufficiently transferred to the second liquid and the liquid is not ejected properly if the distance between the ejection port 11 and each pressure generation element 12 is set too large. On the other hand, by providing the pressure generation elements 12 on the orifice plate 14 as in this embodiment, it is possible to avoid a situation in which the pressure attributed to the generation of the bubbles is not sufficiently transferred to the second liquid even if the distance between the ejection port 11 and each pressure generation element 12 is increased. As a consequence, according to this embodiment, it is possible to eject the liquids without being affected by the distance between the ejection port 11 and each pressure generation element 12, or in other words, by the height of the liquid flow passage. Thus, it is possible to increase the height of the liquid flow passage. Accordingly, this embodiment is capable of not only ejecting the liquids stably but also reducing deterioration in refilling velocity, which is often a problem in the case of using a very viscous liquid, by increasing the height of the liquid flow passage.

Figure 21A:
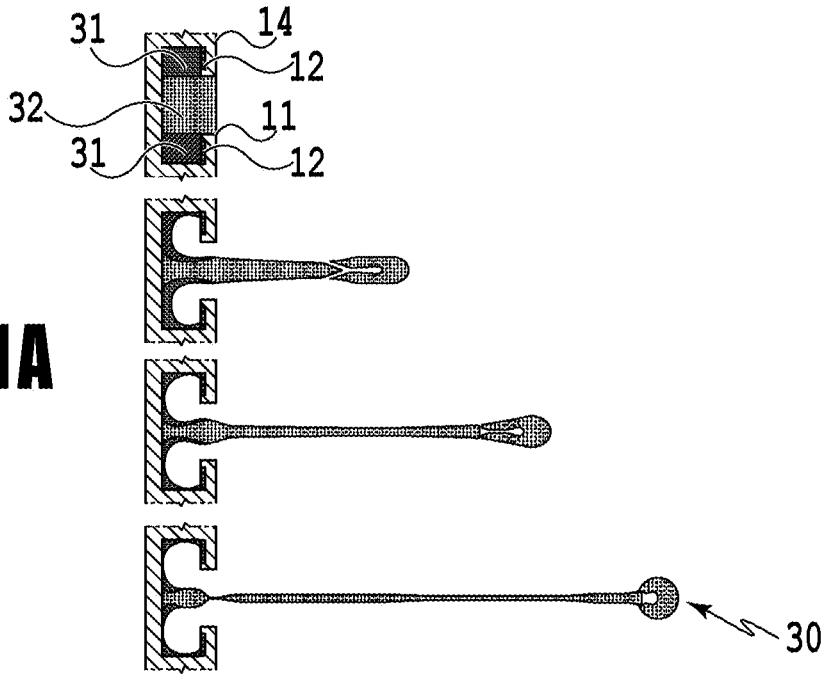
FIGS. 21A and 21B are state diagrams of ejection at various water phase thickness ratios in the fifth embodiment.
Figure 21B:
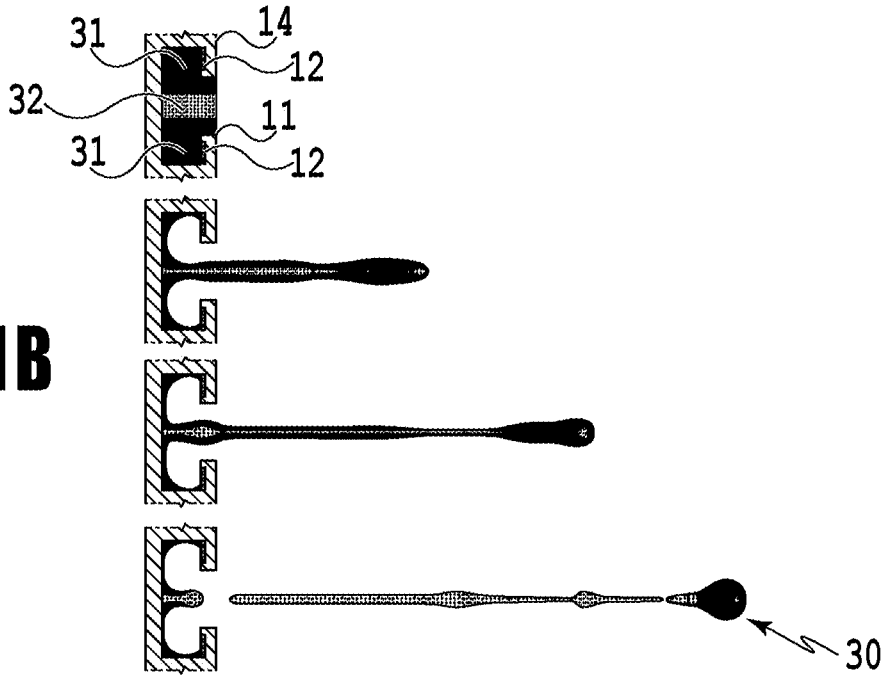

FIGS. 21A and 21B are diagrams showing the ejection process in the case of changing the phase thickness ratio between the first liquid 31 and the second liquid 32 while setting the height of the flow passage to 14 μm, setting the thickness of the orifice plate to 6 μm, and setting the diameter of the ejection port to 10 μm. In each of FIGS. 21A and 21B, the ejection process with the lapse of time is illustrated from the top to the bottom.

In FIG. 21A, the phase thickness ratio is adjusted such that the ejection port 11 is filled only with the second liquid 32 and the first liquid 31 mainly is in contact with each pressure generation element 12. If the ejection operation is carried out in this state, the ejected droplet 30 consists essentially of the second liquid 32 so that the first liquid 31 therein can be minimized. FIG. 21B illustrates the example in which the phase thickness of the second liquid 32 is set smaller than the diameter of the ejection port. Here, the first liquid 31 is included in the ejection port 11. If the ejection operation is carried out in this state, the ejected droplet 30 mainly contains first liquid 31 while partially including the second liquid 32 as well. As described above, by adjusting the water phase thickness ratio, it is possible to control the components to be contained in the ejected droplet 30 and thus to adjust the content rates depending on the intended purpose.

Note that it is also possible to cause the third liquid described in the second embodiment to flow in the pressure chamber in any of the third embodiment, the fourth embodiment, and the fifth embodiment. Moreover, the ejection method is not limited to the configuration in which the pressure generation element and the ejection port are located at the positions opposed to each other. It is also possible to adopt a so-called side-shooter mode in which the ejection port is located at a position at an angle equal to or below 90 degrees with respect to a direction of pressure generation by the pressure generation element.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-143884, filed Jul. 31, 2018, and No. 2019-079641, filed Apr. 18, 2019, which are hereby incorporated by reference herein in their entirety.

What is claimed is:

1. A liquid ejection head comprising:

a pressure chamber configured to allow a first liquid and a second liquid to flow inside;

a pressure generation element configured to apply pressure to the first liquid; and an ejection port configured to eject the second liquid, wherein the liquid ejection head is configured to eject by causing the pressure generation element to apply a pressure to the first liquid in a state in which the first liquid flows in a flowing direction, crossing a direction of ejection of the second liquid from the ejection port, while being in contact with the pressure generation element and the second liquid flows in the flowing direction along the first liquid in the pressure chamber and in which the first liquid and the second liquid are caused to flow steadily, the second liquid being ejected from the ejection port, the first liquid and the second liquid flow in the pressure chamber in the flowing direction side by side with respect to the direction of ejection of the second liquid, and the liquid ejection head satisfies an expression defined as:

$$h_1/(h_1+h_2) \leq -0.1390+0.0155H,$$

where H [μm] is a height of the pressure chamber in the direction of ejection of the second liquid, $h_1$ [μm] is a thickness of the first liquid in the pressure chamber in the direction of ejection of the second liquid, and $h_2$ is a thickness of the second liquid in the pressure chamber in the direction of ejection of the second liquid.

2. The liquid ejection head according to claim 1, wherein the first liquid and the second liquid form laminar flows in the pressure chamber.

3. The liquid ejection head according to claim 1, wherein the first liquid and the second liquid form parallel flows in the pressure chamber.

4. The liquid ejection head according to claim 1, wherein a flow rate of the second liquid is equal or higher than a flow rate of the first liquid in the pressure chamber.

5. The liquid ejection head according to claim 1, wherein the first liquid is not included in a liquid to be ejected from the ejection port.

6. The liquid ejection head according to claim 1, wherein a third liquid further flows in the pressure chamber, and the third liquid flows along the first liquid and the second liquid in the pressure chamber in such a way that the first liquid, the third liquid, and the second liquid are arranged in the listed order.

7. The liquid ejection head according to claim 1, wherein the first liquid is any of water and an aqueous liquid having a critical pressure equal to or above 2 MPa.

8. The liquid ejection head according to claim 1, wherein the second liquid is any of an emulsion and an aqueous ink that contains a pigment.

9. The liquid ejection head according to claim 1, wherein the second liquid is a solid-type ultraviolet curable ink.

10. The liquid ejection head according to claim 1, wherein the first liquid flowing in the pressure chamber is circulated between the pressure chamber and an outside unit.

11. A liquid ejection head comprising:

a pressure chamber configured to allow a first liquid and a second liquid to flow inside;

a pressure generation element configured to apply pressure to the first liquid;

an ejection port configured to eject the second liquid, a first inflow port through which the first liquid flows into the pressure chamber;

a first outflow port through which the first liquid flows out of the pressure chamber;

a second inflow port through which the second liquid flows into the pressure chamber; and a second outflow port through which the second liquid flows out of the pressure chamber, wherein the liquid ejection head is configured to eject by causing the pressure generation element to apply a pressure to the first liquid in a state in which the first liquid flows in a flowing direction, crossing a direction of ejection of the second liquid from the ejection port, while being in contact with the pressure generation element and the second liquid flows in the flowing direction along the first liquid in the pressure chamber and in which the first liquid and the second liquid are caused to flow steadily, the second liquid being ejected from the ejection port, and the second inflow port, the first inflow port, the first outflow port, and the second outflow port are formed by being arranged in the listed order in the flowing direction of the first liquid and the second liquid in the pressure chamber.

12. A liquid ejection apparatus including a liquid ejection head, the liquid ejection head comprising:

a pressure chamber configured to allow a first liquid and a second liquid to flow inside;

a pressure generation element configured to apply pressure to the first liquid;

an ejection port configured to eject the second liquid;

a first inflow port through which the first liquid flows into the pressure chamber;

a first outflow port through which the first liquid flows out of the pressure chamber;

a second inflow port through which the second liquid flows into the pressure chamber; and a second outflow port through which the second liquid flows out of the pressure chamber, wherein the liquid ejection head is configured to eject by causing the pressure generation element to apply a pressure to the first liquid in a state in which the first liquid flows in a flowing direction, crossing a direction of ejection of the second liquid from the ejection port, while being in contact with the pressure generation element and the second liquid flows in the flowing direction along the first liquid in the pressure chamber and in which the first liquid and the second liquid are caused to flow steadily, the second liquid being ejected from the ejection port, and the second inflow port, the first inflow port, the first outflow port, and the second outflow port are formed by being arranged in the listed order in the flowing direction of the first liquid and the second liquid in the pressure chamber.

13. The liquid ejection apparatus according to claim 12, wherein the first liquid and the second liquid form laminar flows in the pressure chamber.

14. The liquid ejection apparatus according to claim 12, wherein the first liquid and the second liquid form parallel flows in the pressure chamber.

15. The liquid ejection apparatus according to claim 12, wherein a flow rate of the second liquid is equal or higher than a flow rate of the first liquid in the pressure chamber.

16. The liquid ejection apparatus according to claim 12, wherein the first liquid is not included in a liquid to be ejected from the ejection port.

17. The liquid ejection apparatus according to claim 12, wherein the first liquid is any of water and an aqueous liquid having a critical pressure equal to or above 2 MPa.

18. The liquid ejection apparatus according to claim 12, wherein the second liquid is any of an emulsion and an aqueous ink that contains a pigment.

19. The liquid ejection apparatus according to claim 12, wherein the second liquid is a solid-type ultraviolet curable ink.

20. The liquid ejection apparatus according to claim 12, wherein the first liquid flowing in the pressure chamber is circulated between the pressure chamber and an outside unit.

21. A liquid ejection module for configuring a liquid ejection head, the liquid ejection module comprising:

a pressure chamber configured to allow a first liquid and a second liquid to flow inside;

a pressure generation element configured to apply pressure to the first liquid;

an ejection port configured to eject the second liquid;

a first inflow port through which the first liquid flows into the pressure chamber;

a first outflow port through which the first liquid flows out of the pressure chamber;

a second inflow port through which the second liquid flows into the pressure chamber; and a second outflow port through which the second liquid flows out of the pressure chamber, wherein the liquid ejection module is configured to eject by causing the pressure generation element to apply a pressure to the first liquid in a state in which the first liquid flows in a flowing direction, crossing a direction of ejection of the second liquid from the ejection port, while being in contact with the pressure generation element and the second liquid flows in the flowing direction along the first liquid in the pressure chamber and in which the first liquid and the second liquid are caused to flow steadily, the second liquid being ejected from the ejection port, the second inflow port, the first inflow port, the first outflow port, and the second outflow port are formed by being arranged in the listed order in the flowing direction of the first liquid and the second liquid in the pressure chamber, and the liquid ejection head is formed by arraying multiple liquid ejection modules.

* * * * *